US007469695B2

(12) United States Patent
Sasaki

(10) Patent No.: US 7,469,695 B2
(45) Date of Patent: Dec. 30, 2008

(54) METHOD OF MANUFACTURING REGULAR POLYHEDRAL ORNAMENT AND THE ORNAMENT

(76) Inventor: Kensuke Sasaki, 116, Kihara, Chizu-cho, Yazu-gun, Tottori, 689-1436 (JP)

( * ) Notice: Subject to any disclaimer, the term of this patent is extended or adjusted under 35 U.S.C. 154(b) by 281 days.

(21) Appl. No.: 10/551,611

(22) PCT Filed: Apr. 16, 2004

(86) PCT No.: PCT/JP2004/005442

§ 371 (c)(1),
(2), (4) Date: Sep. 30, 2005

(87) PCT Pub. No.: WO2004/091880

PCT Pub. Date: Oct. 28, 2004

(65) Prior Publication Data

US 2006/0204774 A1 Sep. 14, 2006

(30) Foreign Application Priority Data

Apr. 17, 2003 (JP) ..... 2003-112613

(51) Int. Cl.
*A63G 31/00* (2006.01)

(52) U.S. Cl. ..... 125/13.01; 125/12; 362/104

(58) Field of Classification Search ..... 362/104, 362/326; 63/37; 428/542; 125/12, 13.01
See application file for complete search history.

(56) References Cited

U.S. PATENT DOCUMENTS

| | | | | | |
|---|---|---|---|---|---|
| 4,061,910 | A * | 12/1977 | Rosenfeld | 362/34 |
| 6,135,601 | A * | 10/2000 | Frucht | 359/850 |
| 6,139,160 | A * | 10/2000 | Frucht | 359/850 |
| 6,439,457 | B1 * | 8/2002 | Marmaropoulos | 235/380 |
| 2005/0157502 | A1 * | 7/2005 | Bayer et al. | 362/326 |

* cited by examiner

*Primary Examiner*—Joseph J. Hail, III
*Assistant Examiner*—Anthony Ojini
(74) *Attorney, Agent, or Firm*—Townsend & Hanta

(57) ABSTRACT

A method for manufacturing a single stone into a regular dodecahedral ornament or a regular icosahedral ornament, and the ornament manufactured according to the method are provided. The method enables the ornament to be manufactured at low costs with ease without using a complicated, numerically computer-controlled shaping machine.

The geometric features determining the faces and ridges of a regular dodecahedron or a regular icosahedron are drawn as cutting base lines on each surface of a cubic workpiece. On a face formed by cutting based on the cutting base lines, new auxiliary cutting lines are sequentially drawn by marking. Then, based on these auxiliary cutting lines and the remaining cutting base lines, a possible cut face is determined, which is in turn cut using a cutting tool. The cutting base lines which are erased after each cutting are complemented by auxiliary cutting lines to find a new possible cut face, which is in turn cut in sequence, thereby manufacturing the regular polyhedral ornament.

4 Claims, 40 Drawing Sheets

METHOD OF MANUFACTURING REGULAR POLYHEDRAL ORNAMENT AND THE ORNAMENT

TECHNICAL FIELD

The present invention relates to a regular polyhedral ornament and a method for manufacturing a raw workpiece of single stone into the regular polyhedral ornament. More particularly, the invention relates to a regular polyhedral ornament and a method for easily manufacturing the ornament by utilizing the geometric features which determine the faces and ridges of a regular polyhedron such as a regular dodecahedron or a regular icosahedron to draw cutting base lines and auxiliary cutting lines by marking or the like, and by cutting the workpiece based thereon using a cutting tool.

BACKGROUND ART

A regular polyhedron is defined as a polyhedron all of whose faces are regular congruent polygons and all of whose vertices have the same number of edges (ridges) meeting together at each thereof. According to the Euler's polyhedron theorem, such a regular polyhedron can exist only in the following five types: a regular tetrahedron, a regular hexahedron, a regular octahedron, a regular dodecahedron, and a regular icosahedron. For example, to form a regular dodecahedron 01, as shown in FIGS. 39 and 40, of a raw metal material, the raw material shaped into a cube can be milled twelve times at a vertex angle of 108 degrees using a computer-controlled milling machine, or can also be shaped using a polyhedron shaping machine disclosed in Japanese Patent Laid-Open Publication No. Hei 9-285923. Alternatively, the regular dodecahedron 01 can also be shaped by casting molten metal into a casting die.

For a raw material of metal, the aforementioned shaping methods would make it possible to readily obtain a regular dodecahedron. However, for a raw material of stone, the milling cutter cannot be used for grinding the stone workpiece to be milled. With the shaping machine according to Japanese Patent Laid-Open Publication No. Hei 9-285923 mentioned above, it is almost impossible to chuck and shape with high accuracy a polyhedron having a complicated structure such as a regular dodecahedron or a regular icosahedron. Furthermore, a material of stone is not compatible with die casting. As such, it was difficult to manufacture ornaments, such as a memorial stone, an object, or a tomb stone, which are formed of a raw material of stone in the shape of a regular dodecahedron or a regular icosahedron. In this context, the applicant has devised the present invention in view of this problem. It is therefore an object (theme) of the invention to provide a method for easily manufacturing a regular polyhedron such as a regular dodecahedron or a regular icosahedron. It is another object of the invention to provide an ornament manufactured according to the method. In the method, a stone is pre-shaped into a cube in preparation for a raw workpiece, and on this cubic workpiece, cutting base lines are drawn which define faces and ridges obtained from the geometric features of a regular dodecahedron or a regular icosahedron. Auxiliary lines are drawn every time each face of the regular polyhedron is ground based on the cutting base lines, and then a next new face is cut based on the auxiliary lines and the cutting base lines. The regular polyhedron is thus manufactured, and an ornament manufactured according to the method is provided.

DISCLOSURE OF THE INVENTION

To solve the aforementioned problem, the present invention provides the following means. That is, the invention according to claim 1 provides a method for manufacturing a regular polyhedral ornament or a regular polyhedron such as a regular dodecahedron or a regular icosahedron. In the method, a stone is shaped into a cube in preparation for a raw workpiece, and then using a cutting tool, the cubic workpiece is cut into the regular polyhedron that is inscribed in the cube. The method is characterized in that the six external surfaces of the cube are marked with cutting base lines which define faces determined by the geometric features of the regular polyhedron and ridges forming contours of the faces. Then, first and second faces of the regular polyhedron which have the ridges in common are cut based on the cutting base lines and thereafter auxiliary cutting lines are marked by drawing on these faces. Further, a new third regular polyhedral face is cut based on the auxiliary cutting lines and the cutting base lines. Subsequently thereafter, the auxiliary cutting lines are drawn in sequence every time a new face of the regular polyhedron is cut from fourth to 12th or to 20th faces to thereby cut the cubic workpiece into the regular polyhedron.

With such an arrangement, the invention according to claim 1 makes it possible to easily manufacture a regular polyhedral ornament using a cutting tool. To this end, a stone is shaped into a cube in preparation for a raw workpiece, and then the six external surfaces of the cube are marked with cutting base lines which define faces determined by the geometric features of the regular polyhedron and ridges forming the contours of the faces. Then, first and second faces of the regular polyhedron are cut based on the cutting base lines and thereafter new auxiliary cutting lines are drawn on these faces. Further, a new third regular polyhedral face is cut based on the auxiliary cutting lines and the cutting base lines. Subsequently thereafter, the auxiliary cutting lines are marked by drawing in sequence every time a new face of the regular polyhedron is cut in the same procedure from fourth to 12th or to 20th faces to thereby cut the cubic workpiece into the regular polyhedron.

The invention according to claim 2 provides a method for manufacturing a regular polyhedral ornament or a regular polyhedron. In the method, a stone is shaped into a cube in preparation for a raw workpiece, and then using a cutting tool, the cubic workpiece is cut into a regular polyhedron that is inscribed in the cube. The method is characterized in that the six external surfaces of the cube are marked with cutting base lines which define faces obtained from the geometric features of the regular polyhedron and ridges forming the contours of the faces. Then, first and second possible cut faces which are envisaged in an inner space of the cube are cut using the cutting tool into first and second faces adjacent to each other based on the cutting base lines which commonly include any one of the ridges. Then, lines forming ridges of the regular polyhedron determined by intersections of the cutting base lines and the faces having been cut are marked by drawing as auxiliary cutting lines on both the first and second faces having been cut. With a new face envisaged in the inner space of the cube being defined as a third possible cut face based on these auxiliary cutting lines and the cutting base lines, the third possible cut face is cut using the cutting tool so as to be formed as a third face of the regular polyhedron. Every time a new face is created by cutting in sequence, the auxiliary cutting lines are drawn to form a possible cut face, thereby allowing the cubic workpiece to be cut into the regular polyhedral ornament.

According to the invention set forth in claim 2, a stone is shaped into a cube in preparation for a raw workpiece to be manufactured into a regular polyhedron which is inscribed in the cube. To this end, the six external surfaces of the cube are marked by drawing with cutting base lines which define faces obtained from the geometric features of the regular polyhedron and ridges forming the contours of the faces. Then, first and second faces adjacent to each other are cut based on the cutting base lines. Then, auxiliary cutting lines are drawn on these faces having been cut to form a new third face based on the auxiliary cutting lines and the cutting base lines. Every time a new face is created by cutting in sequence, the auxiliary cutting lines are drawn to form a new possible cut face. This makes it possible to easily cut a cubic workpiece into a regular polyhedral ornament without using a conventional, costly, computer-controlled shaping machine.

The invention according to claim 3 is related to the method of claim 2 for manufacturing a regular polyhedral ornament. In the method of claim 3, the regular polyhedron is a regular dodecahedron, which is assumed to have an edge of a length of two. In this case, on each surface of the cubic workpiece, plotted on each of the four perimeter edges or ridges are a midpoint and two division points located about the midpoint at a distance of $(1+\sqrt{5})/2$ from each vertex. The invention is characterized in that the cutting base lines marked on each surface based on the geometric features include: a median line which connects between the midpoints on an edge and the opposite edge; two parallel lines which are orthogonal to the median line and which connect respectively between two division points located on the respective edges adjacent to the edge and the opposite edge; and four diagonal lines which are diagonal to the parallel lines and which respectively connect between each of the division points on the edge and the opposite edge and each of the midpoints on the respective adjacent edges.

According to the invention set forth in claim 3, the cutting base lines, indicative of the geometric features of a regular polyhedron, which are marked on each surface of the cubic workpiece include a median line, two parallel lines which are orthogonal to the median line, and four diagonal lines which are diagonal to the parallel lines at the four corners of each surface. Since these lines are straight, each surface can be marked easily. This makes it possible to easily cut the regular dodecahedron into an ornament using a cutting tool.

The invention according to claim 4 is related to the method of claim 2 for manufacturing a regular polyhedral ornament. In the method of claim 4, the regular polyhedron is a regular icosahedron, which is assumed to have an edge of a length of $(1+\sqrt{5})$. In this case, on each surface of the cubic workpiece, plotted on each of the four perimeter edges or ridges are a midpoint and two division points located about the midpoint at a distance of one from each vertex. The invention is characterized in that the cutting base lines marked on each surface based on the geometric features include: a median line which connects between midpoints on an edge and the opposite edge; two parallel lines which are orthogonal to the median line and which connect respectively between two division points located on the respective edges adjacent to the edge and the opposite edge; and four diagonal lines which are diagonal to the parallel lines and which respectively connect between each of the division points on the edge and the opposite edge and each of the midpoints on the respective adjacent edges.

According to the invention set forth in claim 4, the cutting base lines, indicative of the geometric features of a regular polyhedron, which are marked on each surface of the cubic workpiece include a median line, two parallel lines which are orthogonal to the median line, and four diagonal lines which are diagonal to the parallel lines at the four corners of each surface. Since these lines are straight, each surface can be marked easily. This makes it possible to easily cut the regular icosahedron into an ornament using a cutting tool.

The invention according to claim 5 provides an ornament, wherein the cubic workpiece of stone is shaped into a regular dodecahedron or a regular icosahedron according to the method for manufacturing a regular polyhedron set forth in claim 3 or 4.

According to the invention set forth in claim 5, the method for manufacturing a regular polyhedron can be used to easily shape a single cubic workpiece such as of stone, wood, or glass into an ornament which may be used as a memorial stone, an object, a tomb stone, a monument, or the like. This can be done through simple cutting work using only a cutting tool without a need for a costly, expensive machine or apparatus.

In each of the drawings, 1 denotes a cubic workpiece (a raw workpiece of stone); 2 denotes a regular dodecahedral ornament (a regular dodecahedron); 3 denotes a cubic workpiece; 4 denotes a regular icosahedral ornament (a regular icosahedron); 30, 40, 50, 60, 70, 80, 90, 100, 110, 120, 130, 140, 180, 190, 200, 210, 220, 230, 240, 250, 260, 270, 280, 290, 300, 310, 320, 330, 340, 350, 360, and 370 each denote a cutout portion; L1 denotes a median line; L2 and L3 denote parallel lines; L4 to L7 each denote a diagonal line; L10 denotes a median line; L11 and L12 denote parallel lines; L13 to L16 each denote a diagonal line; P denotes a midpoint; and Q denotes a division point.

BEST MODE FOR CARRYING OUT THE INVENTION

Now, embodiments of the present invention will be described below in more detail with reference to FIGS. 1 to 15.

Figure 1:
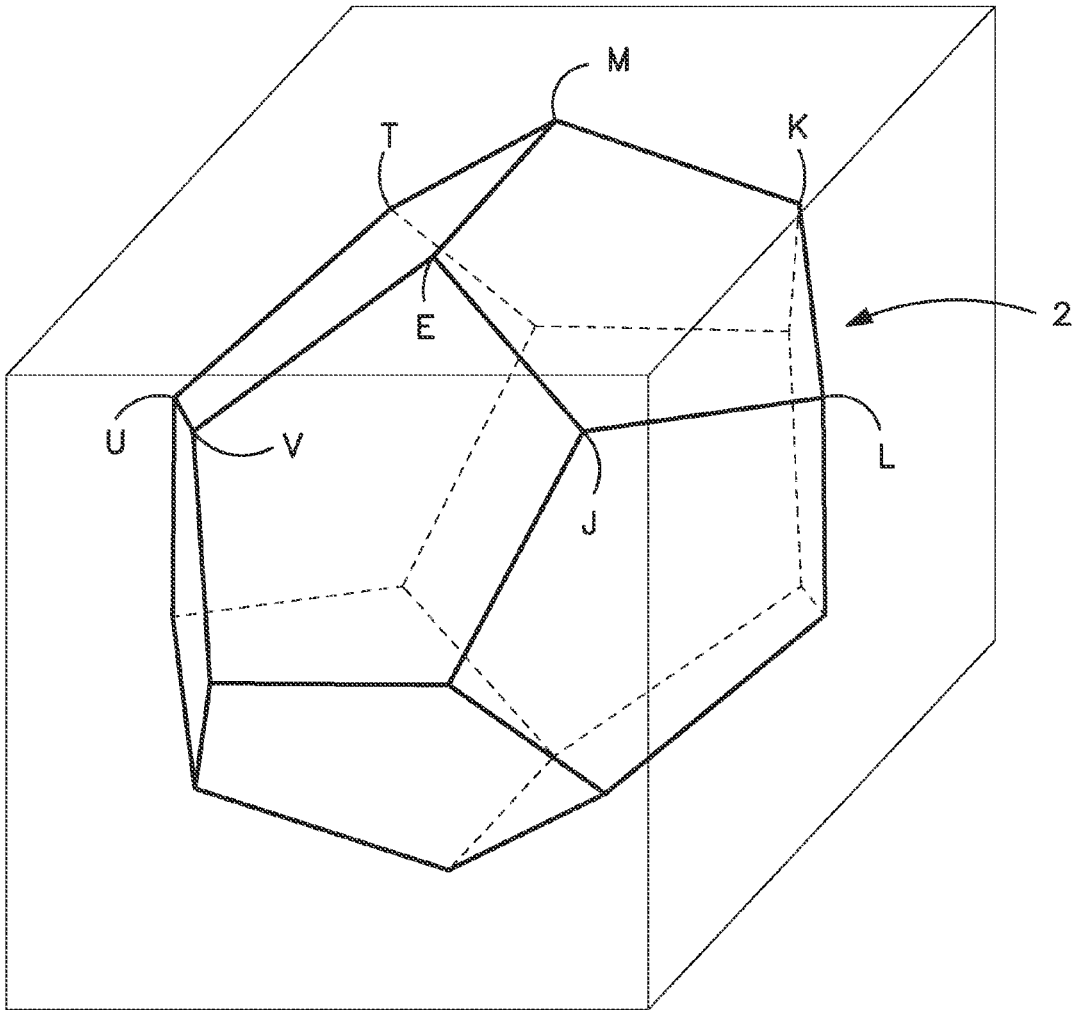
FIG. 1 is an external perspective view showing a regular dodecahedral ornament inscribed in a cubic workpiece according to a first embodiment.

First, as a first embodiment, a description will be made to a method for manufacturing a regular polyhedral ornament in the shape of a regular dodecahedron. As shown in FIG. 1, a stone 1 is shaped into a cube to precise dimensions in preparation for a raw workpiece to be cut (hereinafter also referred to as a "cubic workpiece"). Using a well-known cutting tool (or cutter), the cubic workpiece 1 is cut into a regular dodecahedral ornament (hereinafter also referred to as the "regular dodecahedron" as the case may be) which is inscribed in the cube. To this end, the six external surfaces of the cubic workpiece 1 are pre-marked with lines which define the faces obtained from the geometric features of the regular dodecahedron and the ridges forming the contours of the faces. These lines indicative of the geometric features are common to all the six surfaces of the cubic workpiece 1; the lines to be marked on the surfaces adjacent to each other are shifted in phase by 90 degrees.

Figure 2:
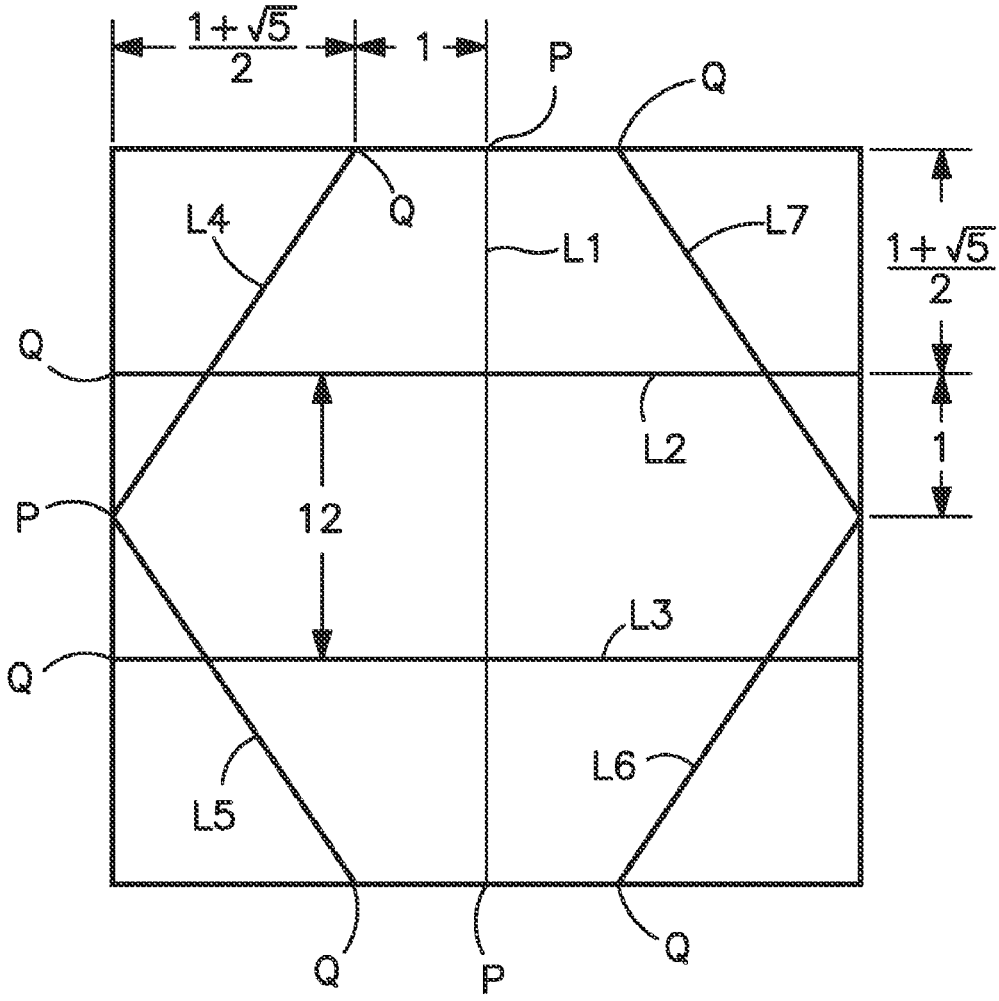
FIG. 2 is an explanatory view showing cutting base lines, indicative of the geometric features of a regular dodecahedron, which are drawn on the cubic workpiece.

That is, as shown in FIG. 2, assume that an edge of the regular dodecahedron has a length of two. In this case, on a surface of the cubic workpiece 1, plotted (marked) on each of the four perimeter edges or ridges are a midpoint P at the middle thereof and division points Q at a distance of $(1+\sqrt{5})/2$ from each vertex (corner). The division points Q on each edge are located on both sides about the midpoint P. Then, a median line L1 is marked to connect between the midpoint P on an edge and the midpoint P on the opposite edge. Additionally, parallel lines L2 and L3, orthogonal to the median line L1, are also marked to connect respectively between two division points Q which are located on the respective edges adjacent to the aforementioned and opposite edges. Then, the division points Q on the aforementioned and opposite edges are each connected to the midpoint P on the edges adjacent thereto to mark four diagonal lines L4, L5, L6, and L7 which diagonally intersect the aforementioned parallel lines L2 and L3. In this manner, seven lines in total are drawn by marking on each surface, thereby forming the cutting base lines as the geometric features of the regular dodecahedron.

Figure 3:
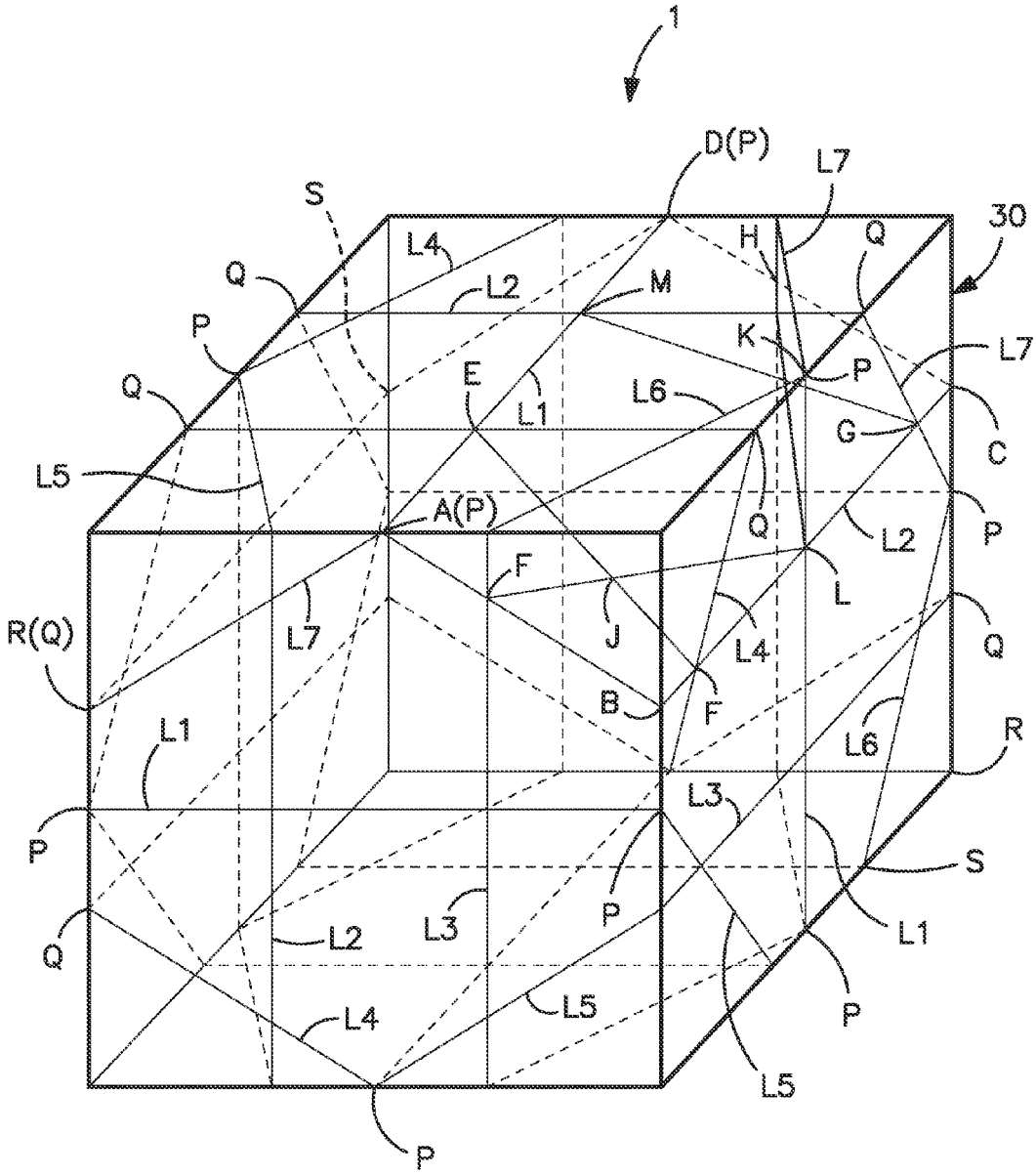
FIG. 3 is an external perspective view showing the cubic workpiece on which the cutting base lines of FIG. 2 are drawn.

As shown in FIG. 3, the cutting base lines L1 to L7 indicative of the geometric features, which are drawn by marking in this manner, are engraved on the cubic workpiece 1 (with the ridges enhanced by bold lines in the drawing). For example, when the cutting base lines L1 to L7 directed in the same direction as shown in FIG. 2 are drawn on the upper surface, the cutting base lines directed in the same direction as those on the upper surface are also marked on the lower outer surface of the cubic workpiece 1. Additionally, on the front and rear surfaces of the cubic workpiece 1, the cutting base lines are also drawn which are different in phase by 90 degrees from and directed in the same direction as those drawn on the upper and lower surfaces. Furthermore, on the right and left side surfaces, the cutting base lines are also drawn which are different in phase by 90 degrees from and directed in the same direction as those drawn on the upper and lower surfaces. The cutting base lines L1 to L7 on the upper and lower surfaces, those on the front and rear surfaces, and those on the right and left side surfaces are different in phase by 90 degrees from each other.

Now, referring to FIGS. 3 to 15, a description will be made to a method of cutting the cubic workpiece 1 to manufacture a regular dodecahedral ornament 2 (see FIG. 1). That is, in FIG. 3, a plane formed by connecting between points A, B, C, and D which commonly include a ridge EM (points A and D are also midpoints P, and points B and C are also division points) and a plane formed by connecting between points A, R, S, and D (points R and S are also division points) are formed in the inner space of the cubic workpiece 1 as a first possible cut face and a second possible cut face, respectively.

Figure 4:
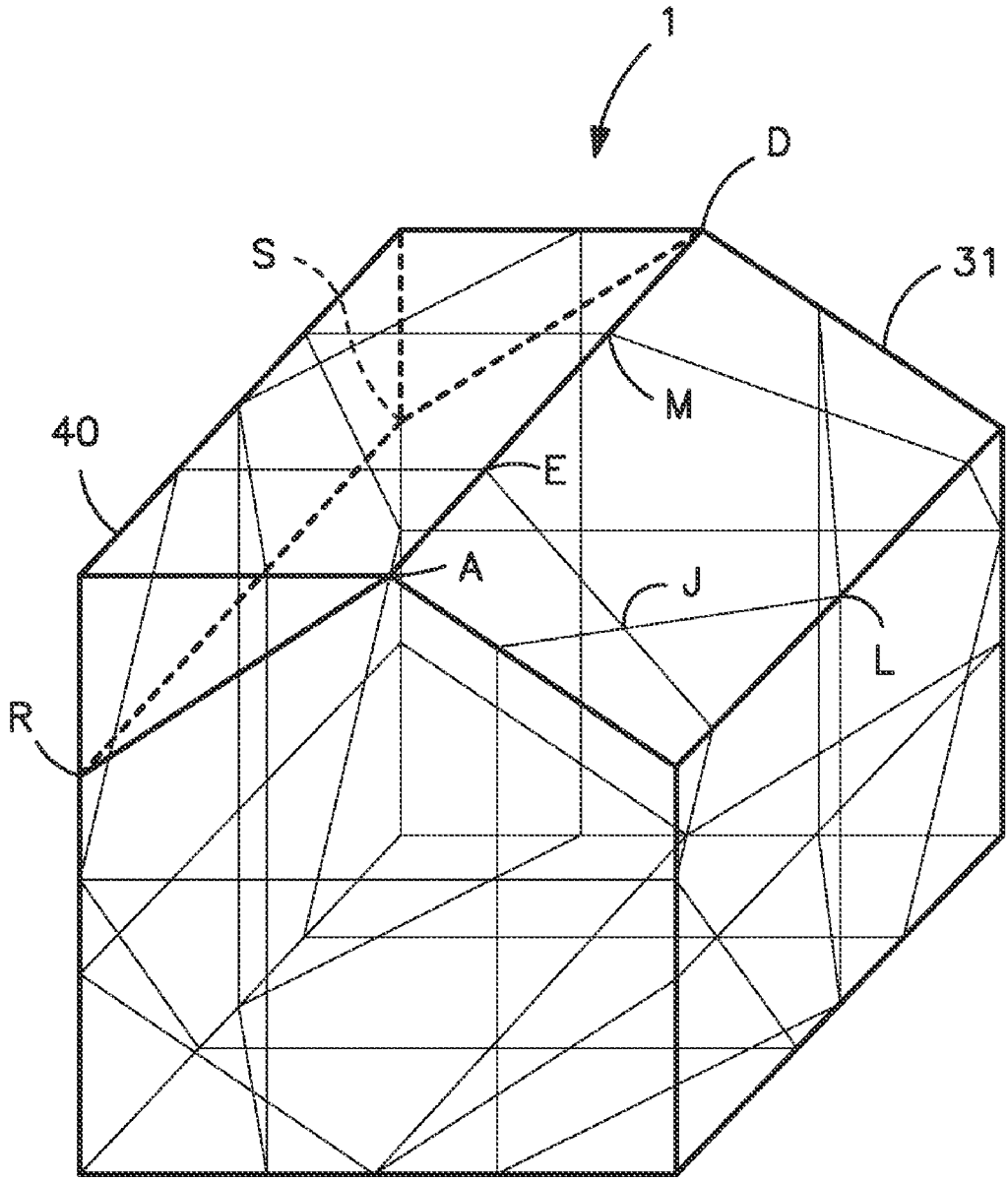
FIG. 4 is an external perspective view showing a first face of the regular dodecahedron formed on the workpiece.
Figure 5:
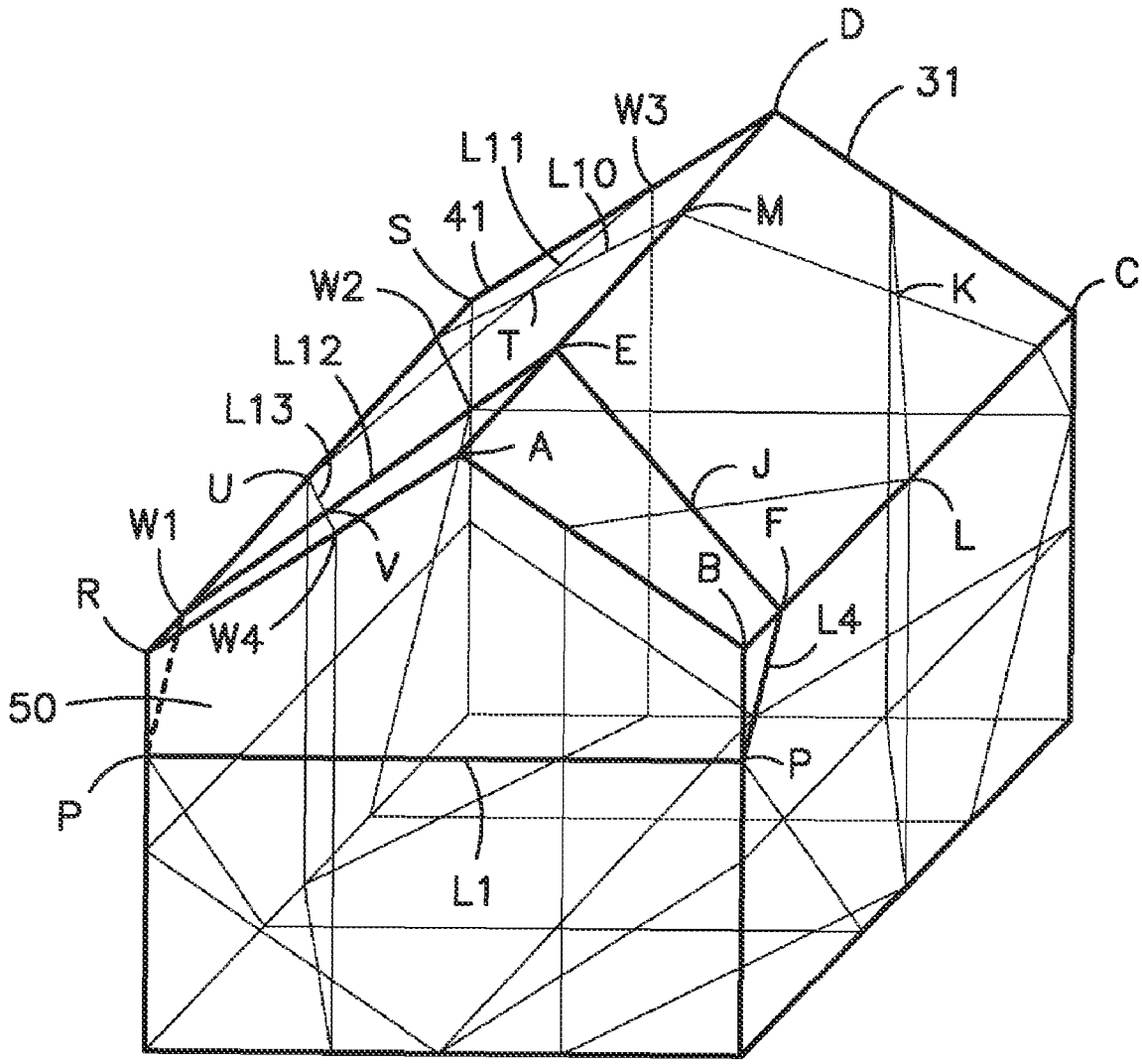
FIG. 5 is an external perspective view showing a second face of the regular dodecahedron formed on the workpiece.

A cutout portion 30 (which exhibits the shape of a triangular prism including the possible cut face ABCD) is cut away from the first possible cut face ABCD with accuracy using a cutting tool (not shown) to obtain a first face ABCD (shown by reference numeral "31" in FIGS. 4 and 5). On the first face ABCD which has been shaped and exposed on the surface in this manner, lines will be marked while a drawing is being created as follows. That is, drawn are a line EF and a line MG, serving as auxiliary cutting lines, which are defined by intersections F and G of the cutting base lines L4 and L7 on the right side face and the first face and which each form a ridge of the regular dodecahedron. Also drawn are a line LI and a line LH, serving as auxiliary cutting lines, which are respectively defined by an intersection I of the cutting base line L3 on the front surface and the first face and by an intersection H of the cutting base line on the rear surface and the first face and which each form a ridge of the regular dodecahedron. As a result, letting the intersection of the line EF and the line LI serving as auxiliary cutting lines be J and the intersection of the line MG and the line LH be K, a regular pentagon which is defined by points E, M, K, L, and J appears on the first face ABCD to form a face of the regular dodecahedron 2 (see FIGS. 1, 3, and 4).

Likewise, as shown in FIG. 4, with the second possible cut face ARSD (shown by reference numeral "41" in FIG. 4) adjacent to the first face ABCD, a cutout portion 40 (which exhibits the shape of a triangular prism including the second possible cut face ARSD) is cut away to expose the second face ARSD as shown in FIG. 5. On the second face ARSD, lines which are to form the ridges of the regular dodecahedron 2 defined by intersections W1, U, W2, W3, and W4 of the cutting base lines and the second face ARSD are also drawn as auxiliary cutting lines L10 to L13. This allows a regular pentagon EMTUV to appear adjacent to the aforementioned regular pentagon EMKLJ as a face of the regular dodecahedron (see FIGS. 1 and 5).

Figure 6:
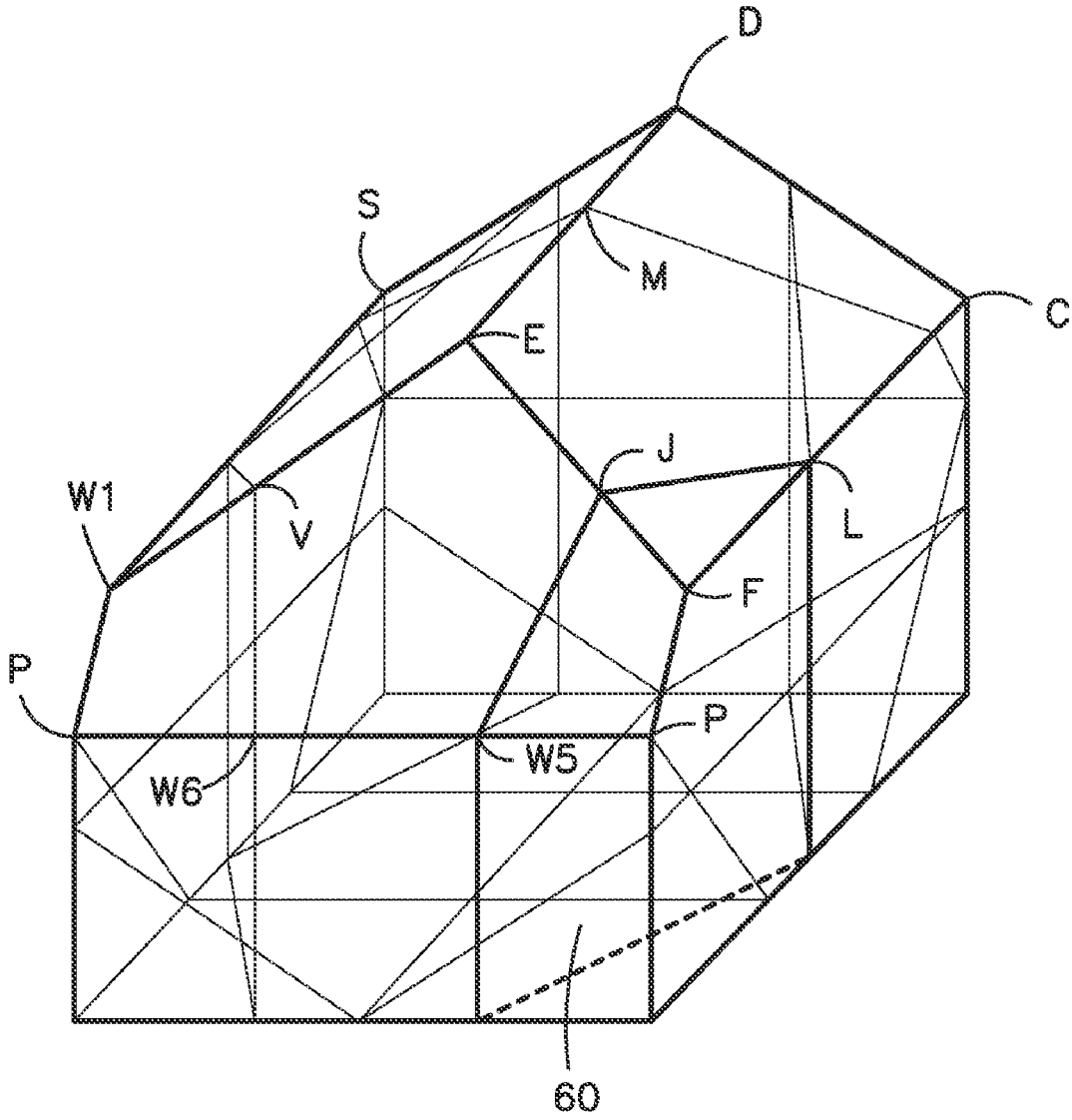
FIG. 6 is an external perspective view showing a third face of the regular dodecahedron formed on the workpiece.
Figure 7:
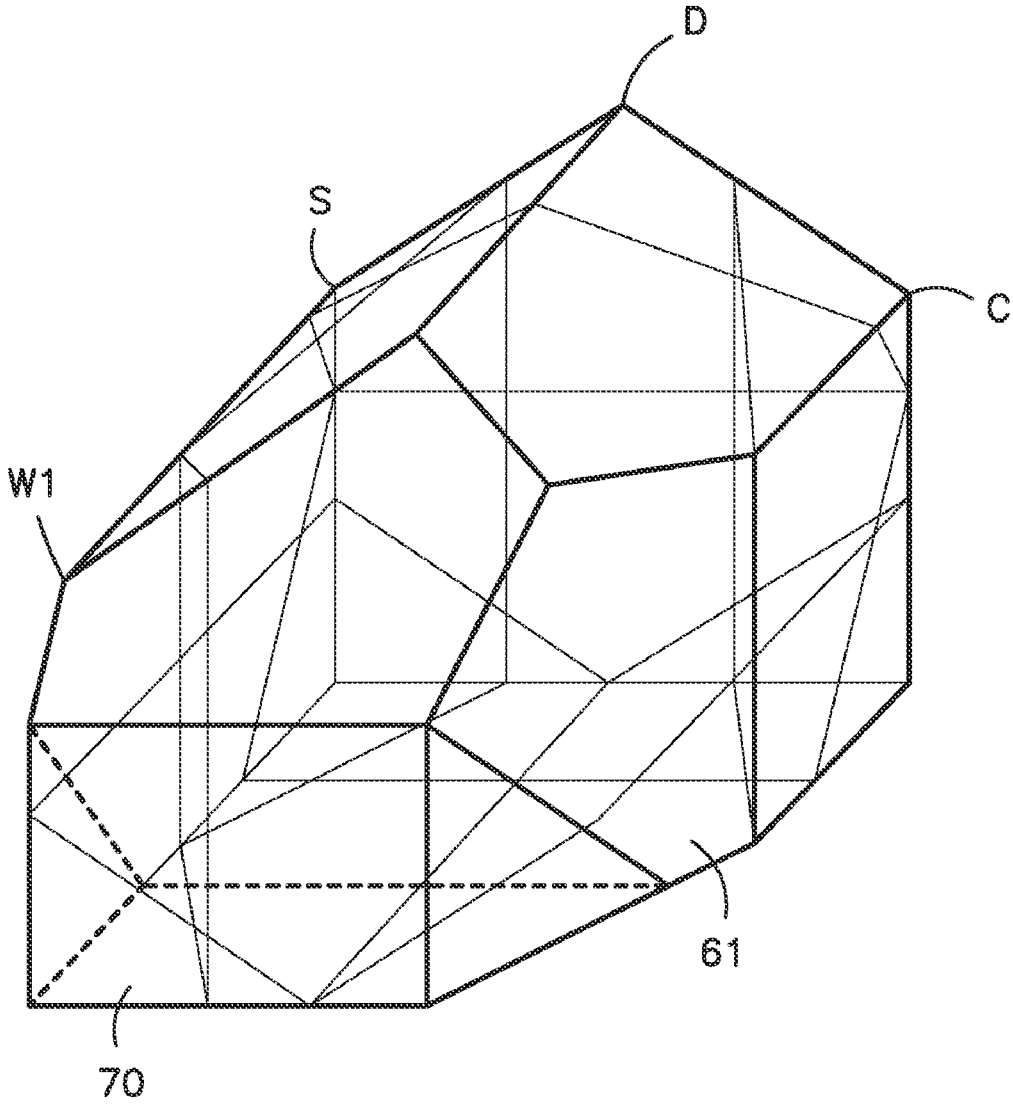
FIG. 7 is an external perspective view showing a fourth face of the regular dodecahedron formed on the workpiece.

Then, as shown in FIG. 5, a new third possible cut face EFPPRW1 is envisaged (formed) based on the auxiliary cutting lines EF and EW1 (L12) drawn on the first face ABCD and the second face ARSD, and the cutting base lines such as of the lines AB, AR, AE, BF, FP, PP (line L1), PR, and RW1. A cutout portion 50 is cut away from the third possible cut face EFPPRW1 using a cutting tool. As a result, the cubic workpiece 1 changes into a shape as shown in FIG. 6, where the third possible cut face EFPPRW1 has been cut into a new third face EFPPRW1 (shown by reference numeral "51" in FIG. 6) and exposed. Likewise, auxiliary cutting lines JW5 and VW6 are also marked by drawing on the third face EFPPRW1 (see FIG. 6).

Figure 8:
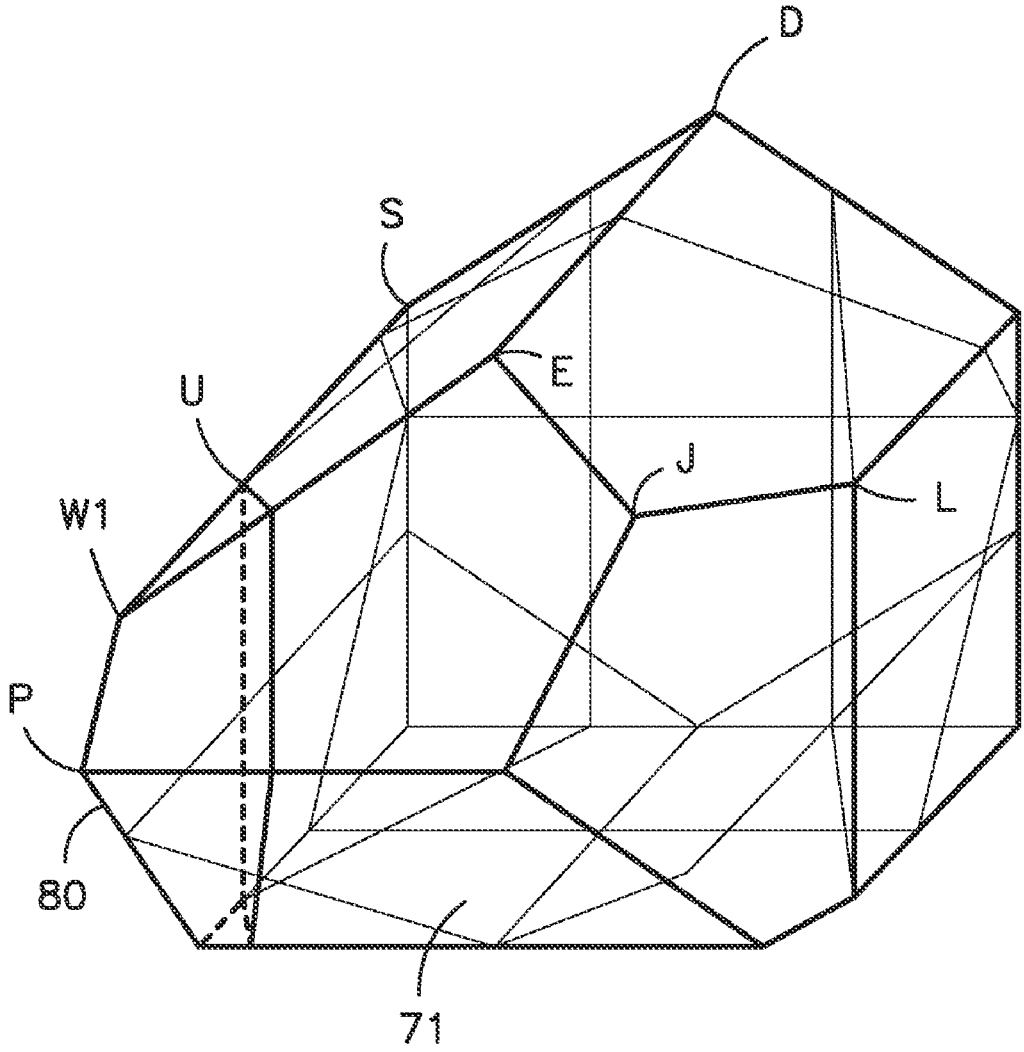
FIG. 8 is an external perspective view showing a fifth face of the regular dodecahedron formed on the workpiece.
Figure 9:
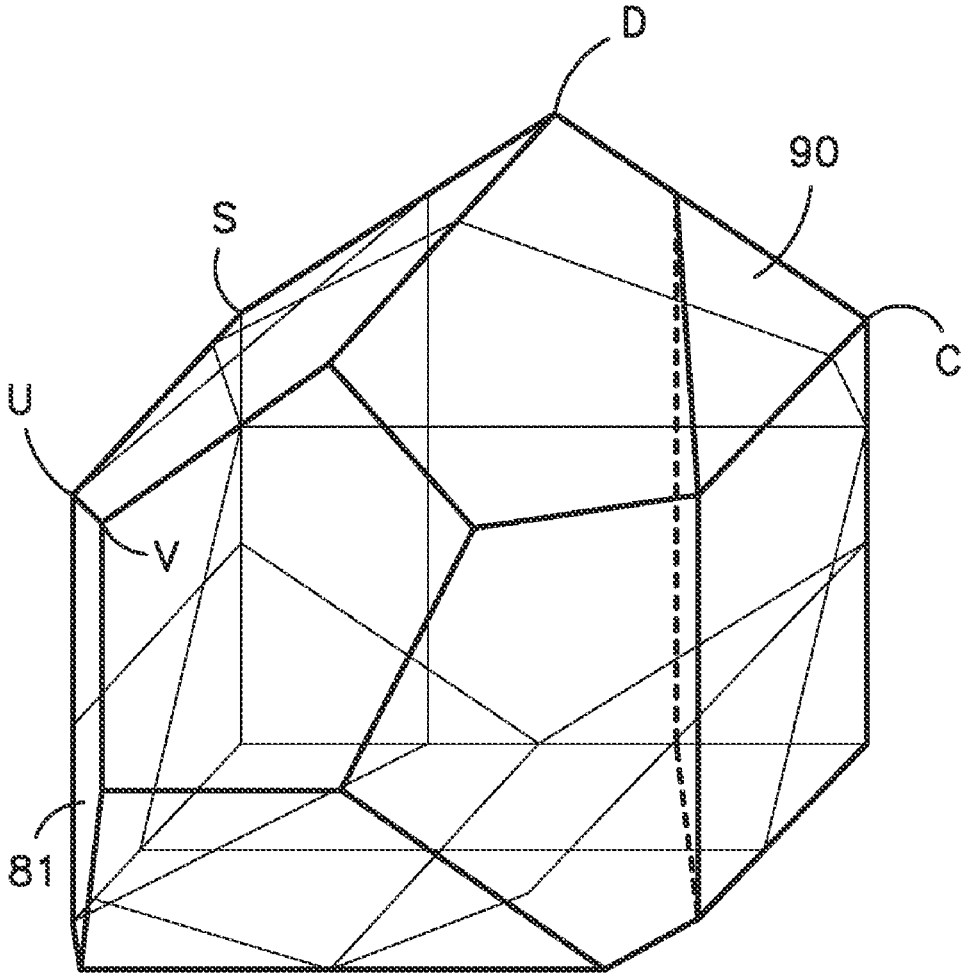
FIG. 9 is an external perspective view showing a sixth face of the regular dodecahedron formed on the workpiece.
Figure 10:
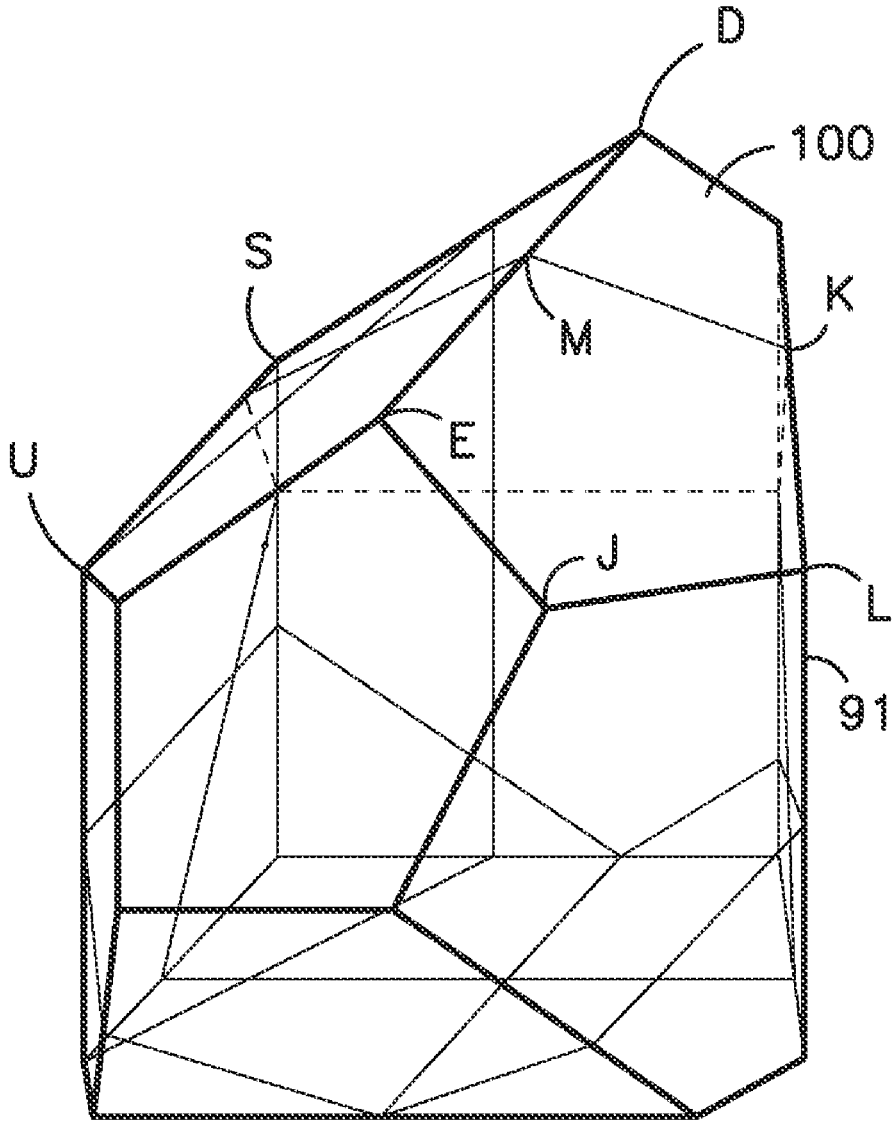
FIG. 10 is an external perspective view showing a seventh face of the regular dodecahedron formed on the workpiece.
Figure 11:
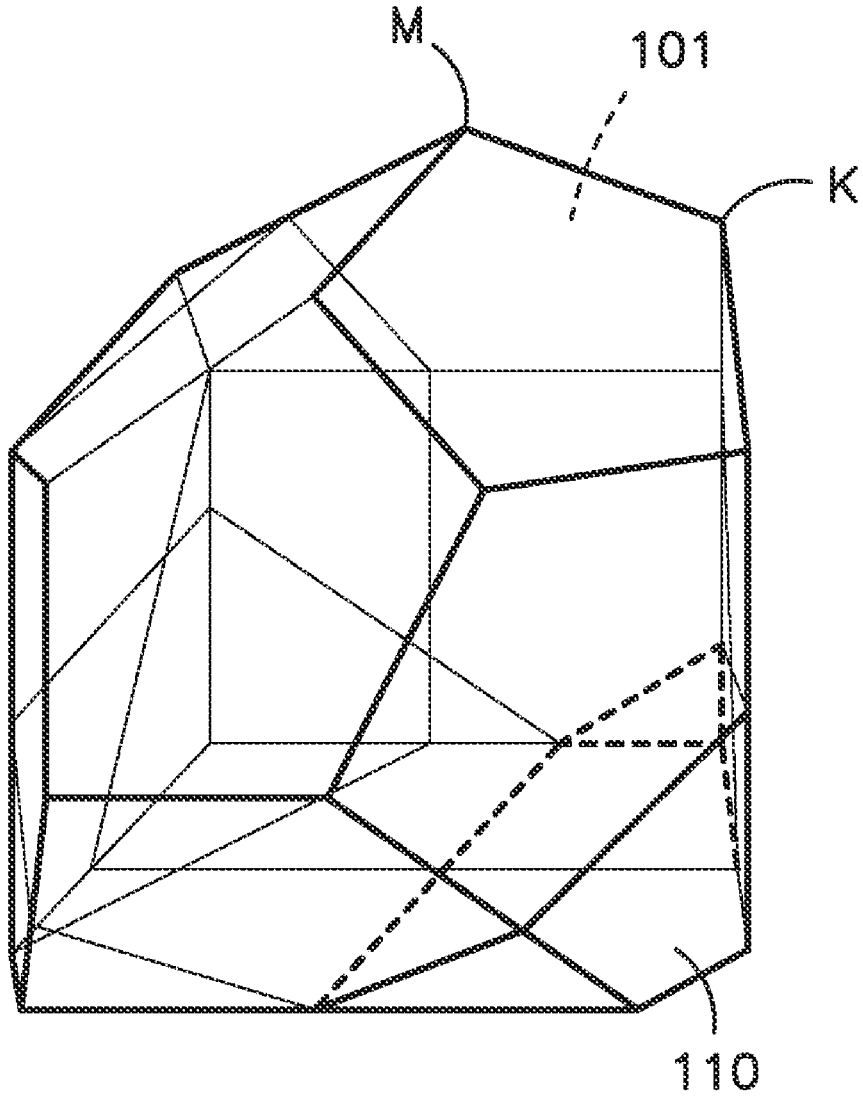
FIG. 11 is an external perspective view showing an eighth face of the regular dodecahedron formed on the workpiece.
Figure 12:
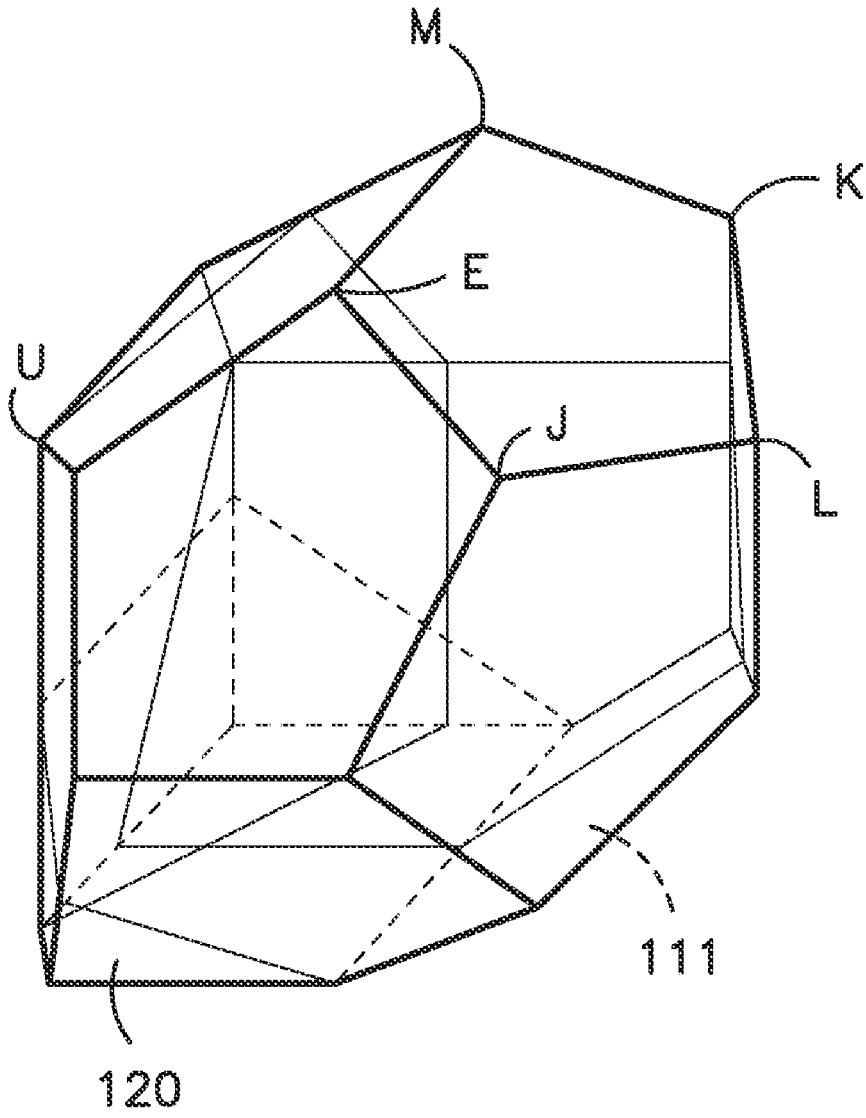
FIG. 12 is an external perspective view showing a ninth face of the regular dodecahedron formed on the workpiece.
Figure 13:
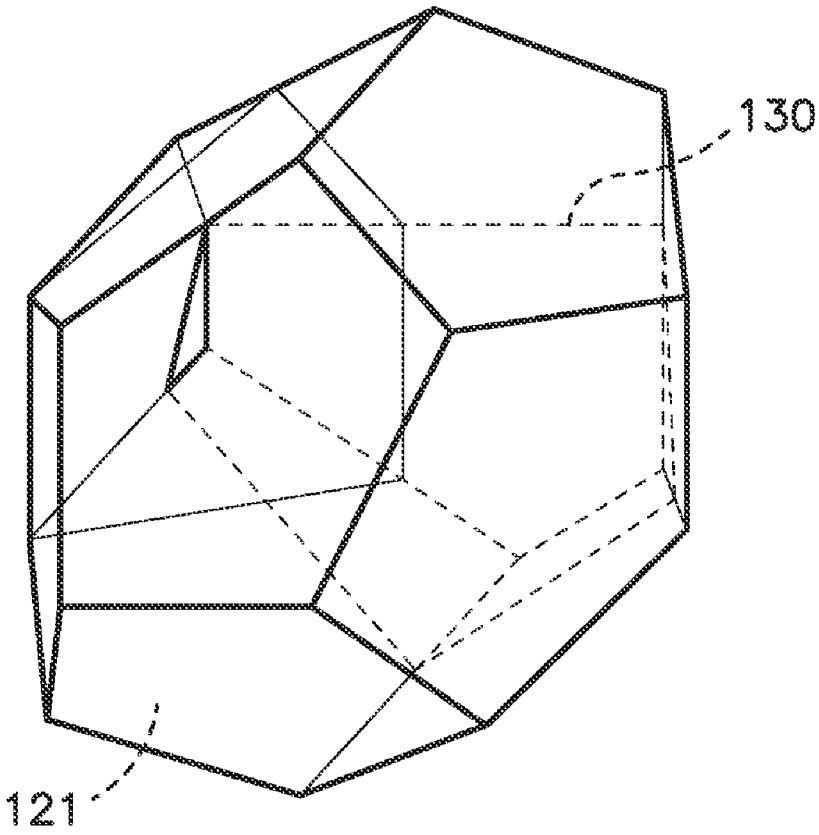
FIG. 13 is an external perspective view showing a 10th face of the regular dodecahedron formed on the workpiece.
Figure 14:
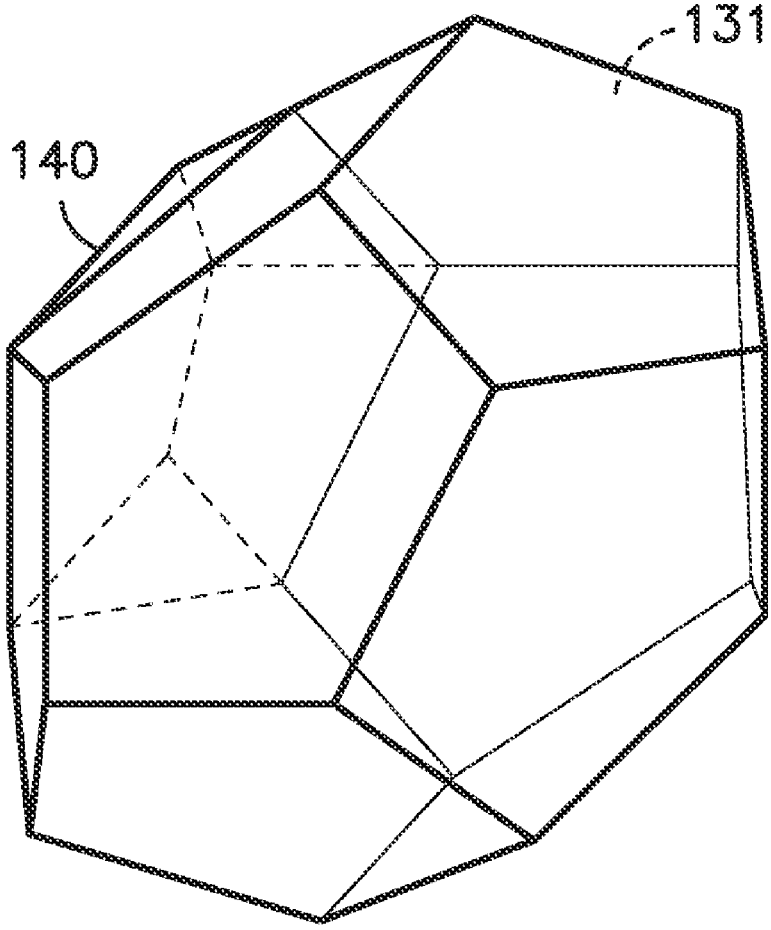
FIG. 14 is an external perspective view showing an 11th face of the regular dodecahedron formed on the workpiece.
Figure 15:
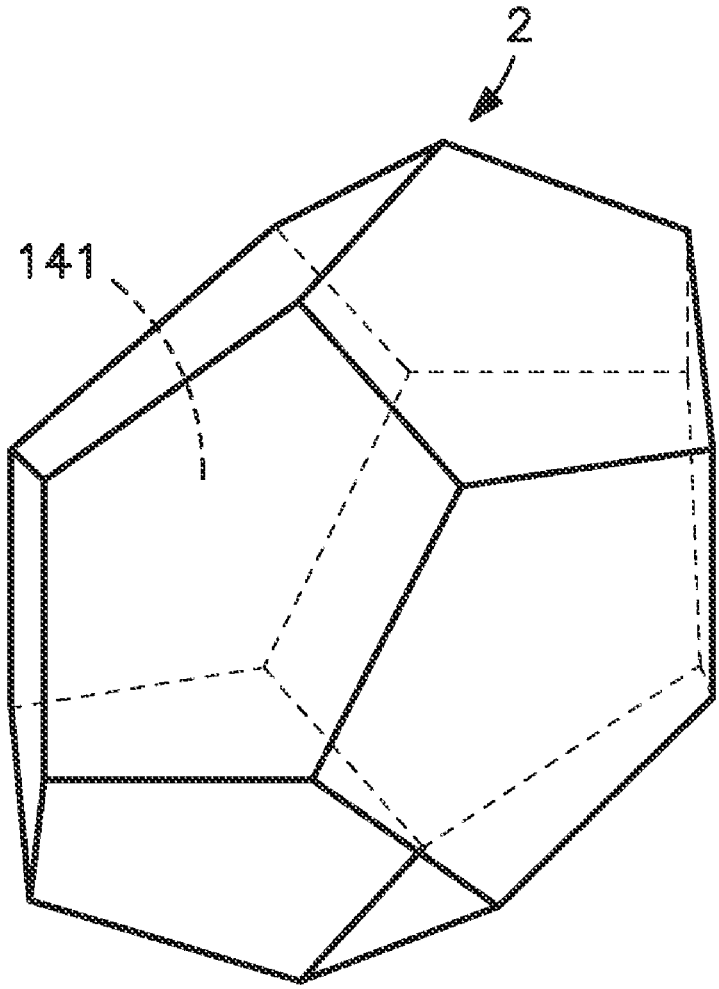
FIG. 15 is an external perspective view showing a 12th face of the regular dodecahedron formed on the workpiece.

Thus, subsequently in the same manner, until the 12th face of the regular dodecahedron is formed, the steps of drawing auxiliary cutting lines every time a new face is sequentially created by cutting to thereby envisage (form) a new possible cut face and then cutting the possible cut face will be repeated. That is, a cutout portion 60 shown in FIG. 6 is cut away to thereby form a fourth face 61 shown in FIG. 7, and a cutout portion 70 is cut away to thereby form a fifth face 71 shown in FIG. 8. A cutout portion 80 shown in FIG. 8 is cut away to thereby form a sixth face 81 shown in FIG. 9, and a cutout portion 90 is cut away to thereby form a seventh face 91 shown in FIG. 10. A cutout portion 100 is cut away in FIG. 10 to thereby form an eighth face 101 shown in FIG. 11, and a cutout portion 110 of FIG. 11 is cut away to thereby form a ninth face 111 of FIG. 12. Furthermore, a cutout portion 120 of FIG. 12 is cut away to thereby form a 10th face 121 shown in FIG. 13, a cutout portion 130 of FIG. 13 is cut away to thereby form an 11th face 131 shown in FIG. 14, and a cutout portion 140 of FIG. 14 is cut away to thereby form a 12th face 141 shown in FIG. 15. In this manner, as shown in FIG. 15, the regular dodecahedral ornament 2 that is inscribed in the cubic workpiece 1 (see FIG. 1) is manufactured using a cutting tool. Then, by polishing all the twelve faces using a grindstone or the like, an ornament of stone is completed in the shape of a regular dodecahedron.

Figure 16:
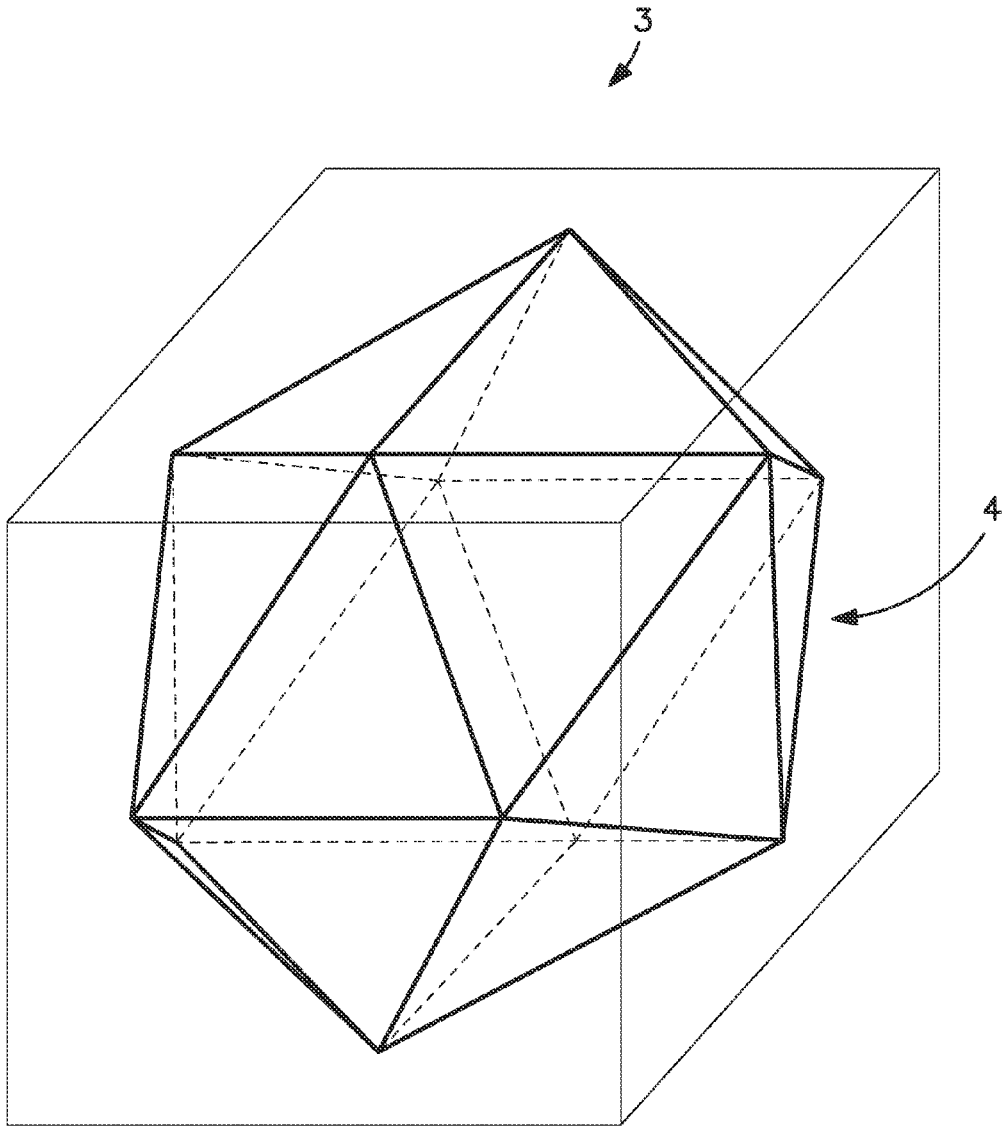
FIG. 16 is an external perspective view, like FIG. 1, showing a regular icosahedron inscribed in a cubic workpiece according to a second embodiment.

Now, as a second embodiment of the present invention, a description will be made to a method for manufacturing a regular polyhedral ornament in the shape of a regular icosahedron into. As shown in FIG. 16, prepared first is a cubic workpiece 3 which has been shaped into a cube to precise dimensions. Now, a regular icosahedral ornament 4 (hereinafter also referred to as the "regular icosahedron" as the case may be) will be manufactured by cutting. To this end, like the case of the aforementioned regular dodecahedron, the six external surfaces of the cubic workpiece 3 are pre-marked with lines which define the faces obtained from the geometric features of the regular icosahedron and the ridges forming the contours of the faces. These lines indicative of the geometric features are common to all the six surfaces of the cubic workpiece 3; the lines marked on the surfaces adjacent to each other are shifted in phase by 90 degrees.

Figure 17:
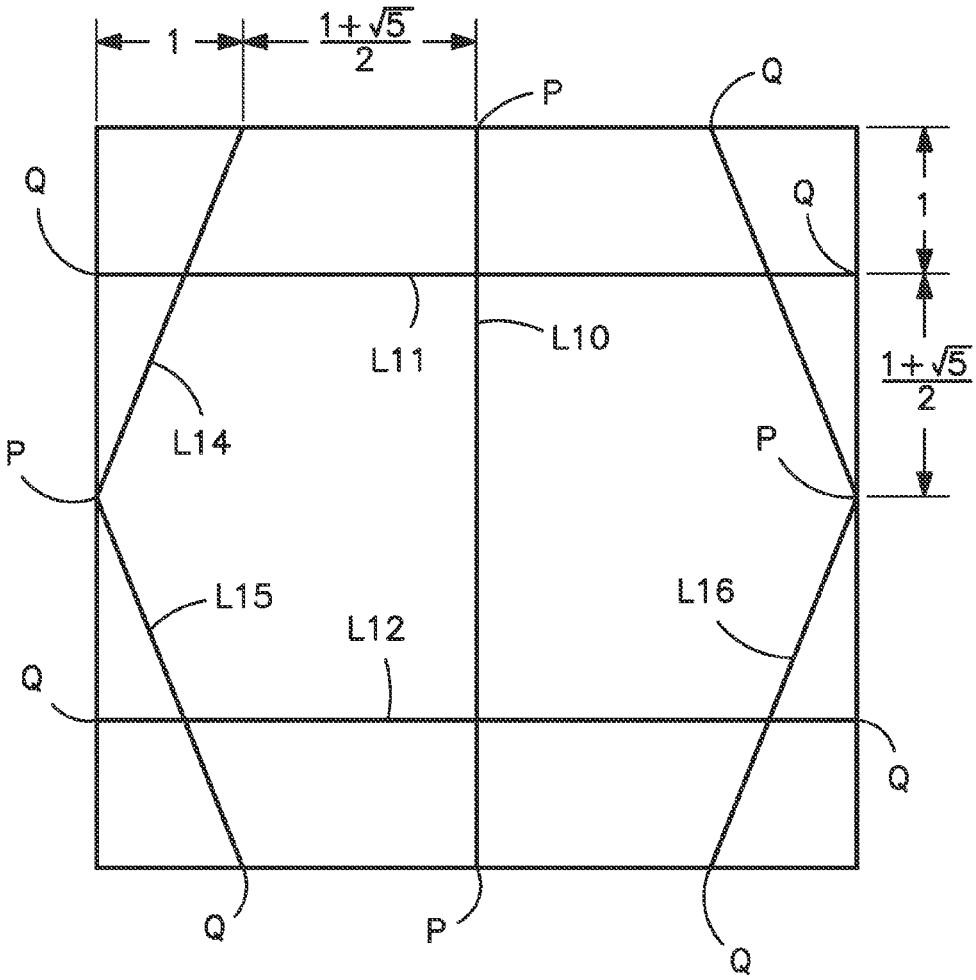
FIG. 17 is an explanatory view, like FIG. 2, showing cutting base lines, indicative of the geometric features of the regular icosahedron, which are drawn on the surfaces of the cubic workpiece according to the second embodiment.

That is, as shown in FIG. 17, assume that an edge of the regular icosahedron has a length of $(1+\sqrt{5})$. In this case, on a surface of the cubic workpiece 3, plotted are a midpoint P at the middle of each of four edges and division points Q at a distance of one from each vertex (corner). The division points Q on each edge are located on both sides about the midpoint P. Then, a median line L10 is marked to connect between the midpoint P on an edge and the midpoint P on the opposite edge. Additionally, parallel lines L11 and L12, orthogonal to the median line L10, are also marked to connect respectively between two division points Q which are located on the respective edges adjacent to the aforementioned and opposite edges. Then, the division points Q on the aforementioned and opposite edges are each connected to the midpoint P on the edges adjacent thereto to mark four diagonal lines L13 to L16 which diagonally intersect the aforementioned parallel lines L11 and L12. In this manner, seven lines in total are drawn by marking on each surface, thereby forming the cutting base lines as the geometric features of the regular dodecahedron.

Figure 18:
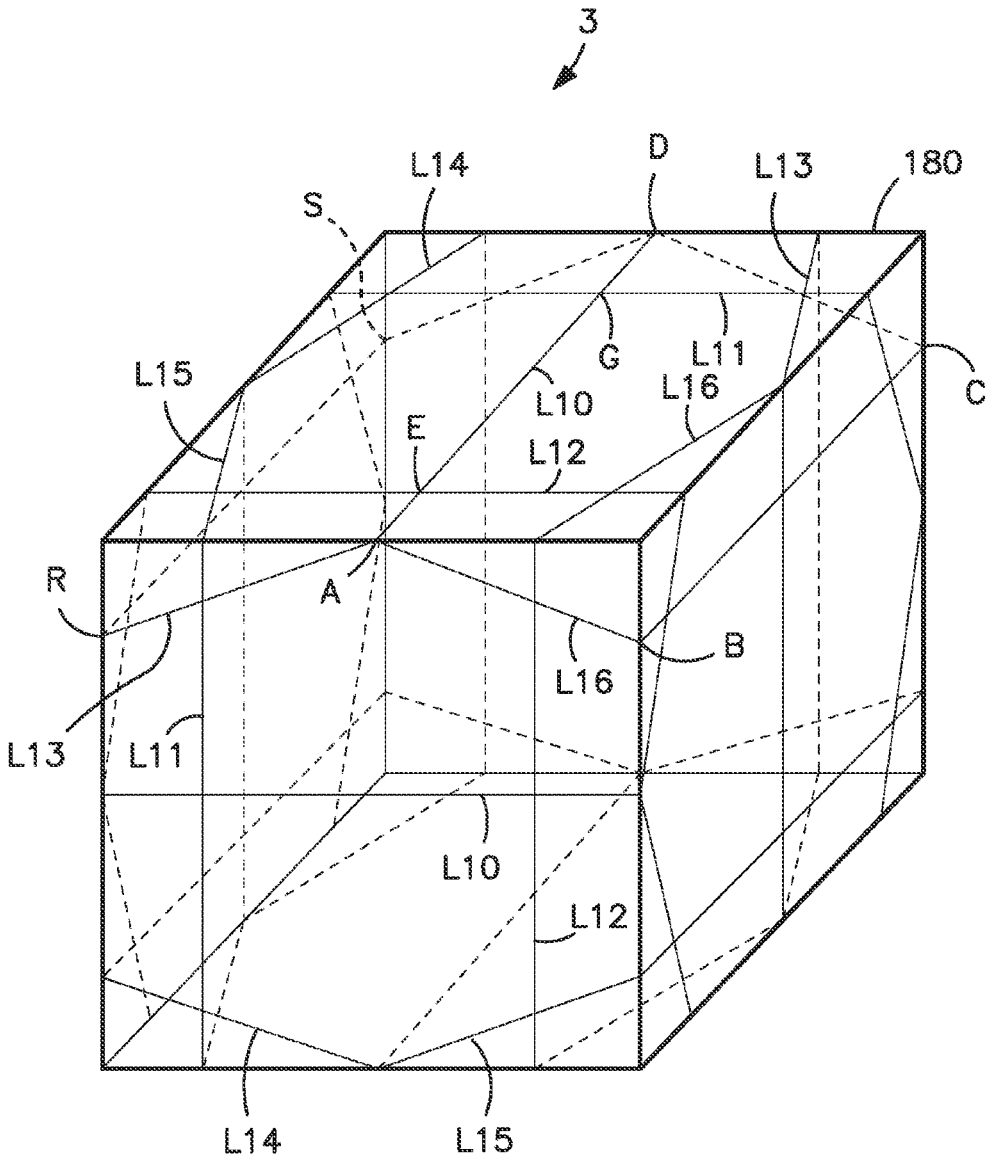
FIG. 18 is an external perspective view, like FIG. 2, showing cutting base lines, indicative of the geometric features of the regular icosahedron, which are drawn on the surfaces of the cubic workpiece.

As shown in FIG. 18, the cutting base lines L10 to L16 indicative of the geometric features, which are drawn by marking in this manner, are engraved on all the six surfaces of the cubic workpiece 1 (with the ridges enhanced by bold lines in the drawing). The cutting base lines L10 to L16 on the upper and lower surfaces, those on the front and rear surfaces, and those on the right and left side surfaces are different in phase by 90 degrees from each other.

Now, referring to FIGS. 18 to 38, a description will be made to a method of cutting the cubic workpiece 3 to manufacture a regular icosahedral ornament 4 (see FIG. 16). For simplicity, the alphabetical symbols used in these figures are like those used in FIGS. 1 to 15 shown above but different from those of the aforementioned first embodiment. Furthermore, the procedure of manufacturing the regular icosahedral ornament 4 is generally the same as that for the aforementioned regular dodecahedron and will be thus explained briefly.

Figure 19:
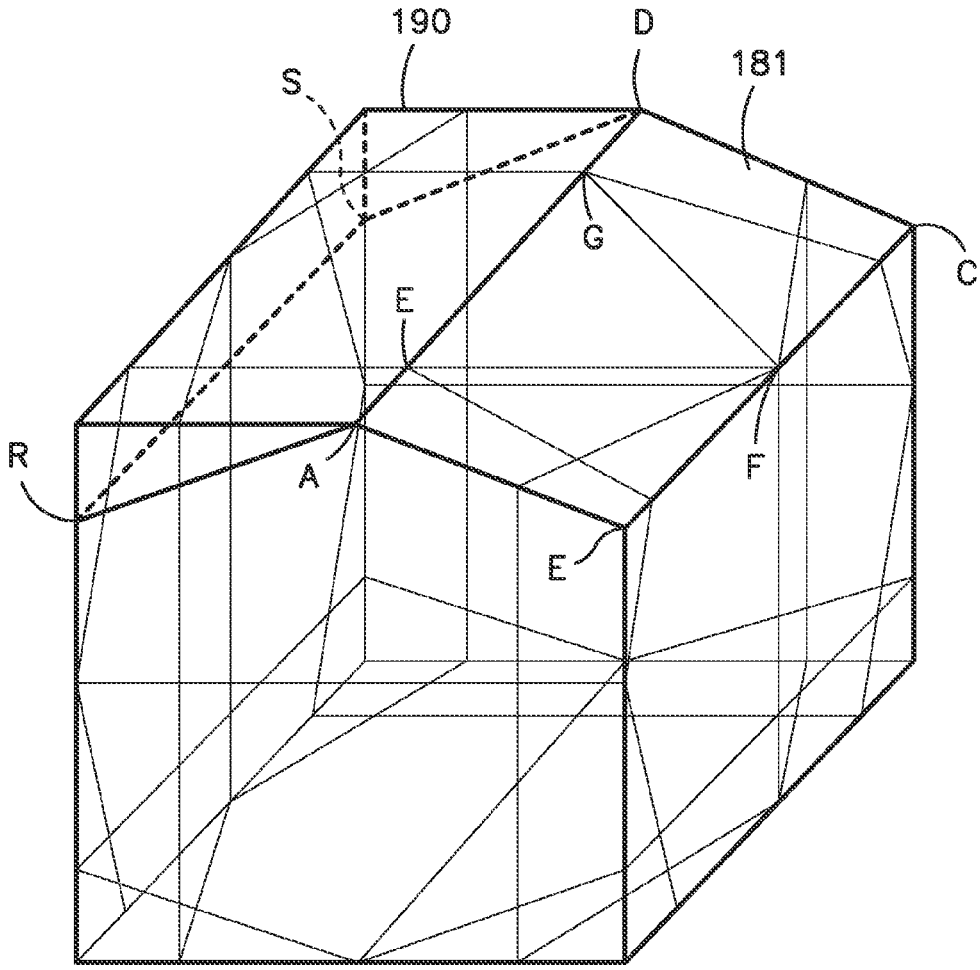
FIG. 19 is an external perspective view showing a first face of the regular icosahedron formed on the workpiece.
Figure 20:
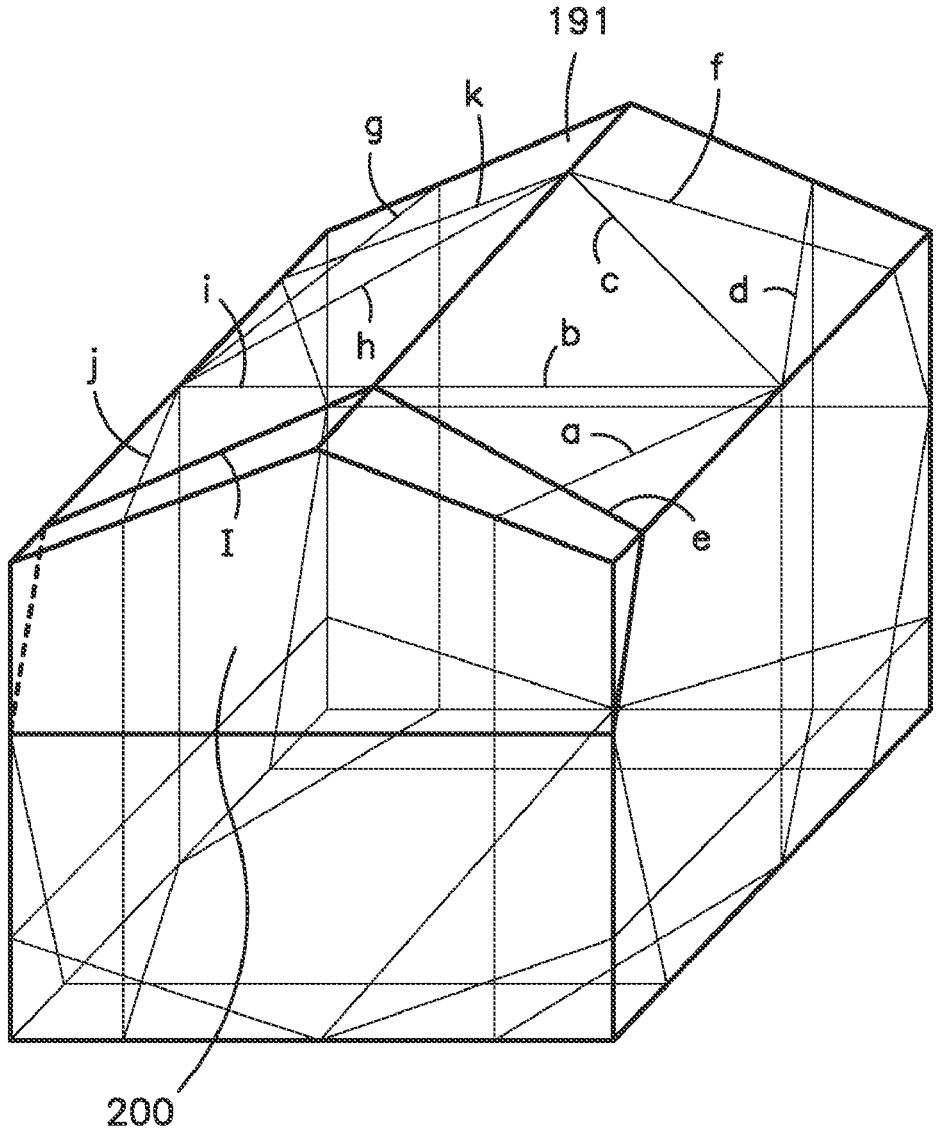
FIG. 20 is an external perspective view showing a second face of the regular icosahedron formed on the workpiece.

That is, in FIG. 18, a plane formed by connecting between points A, B, C, and D (points A and D are also midpoints P, and points B and C are also division points) and a plane formed by connecting between points A, R, S, and D (points R and S are also division points) are formed as a first possible cut face and a second possible cut face, respectively. A cutout portion 180 is cut away from the first possible cut face ABCD using a cutting tool to form a first face 181 on the cubic workpiece 3 as shown in FIG. 19. Additionally, a cutout portion 190 is cut away from the second possible cut face ARSD to thereby form a second face 191 as shown in FIG. 20. As shown in FIG. 20, auxiliary cutting lines "a" to "f" are marked by drawing on the first face 181, and auxiliary cutting lines "g" to "l" are marked by drawing on the second face 191.

Figure 21:
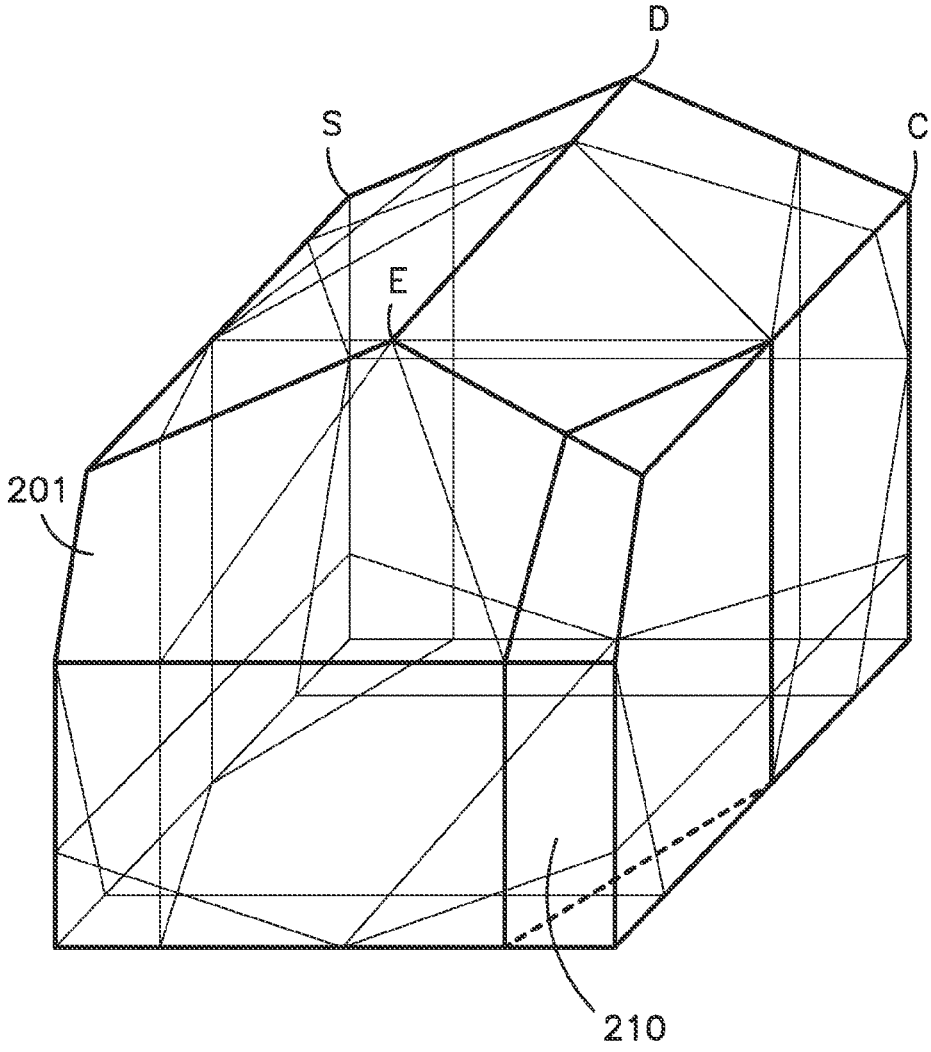
FIG. 21 is an external perspective view showing a third face of the regular icosahedron formed on the workpiece.
Figure 22:
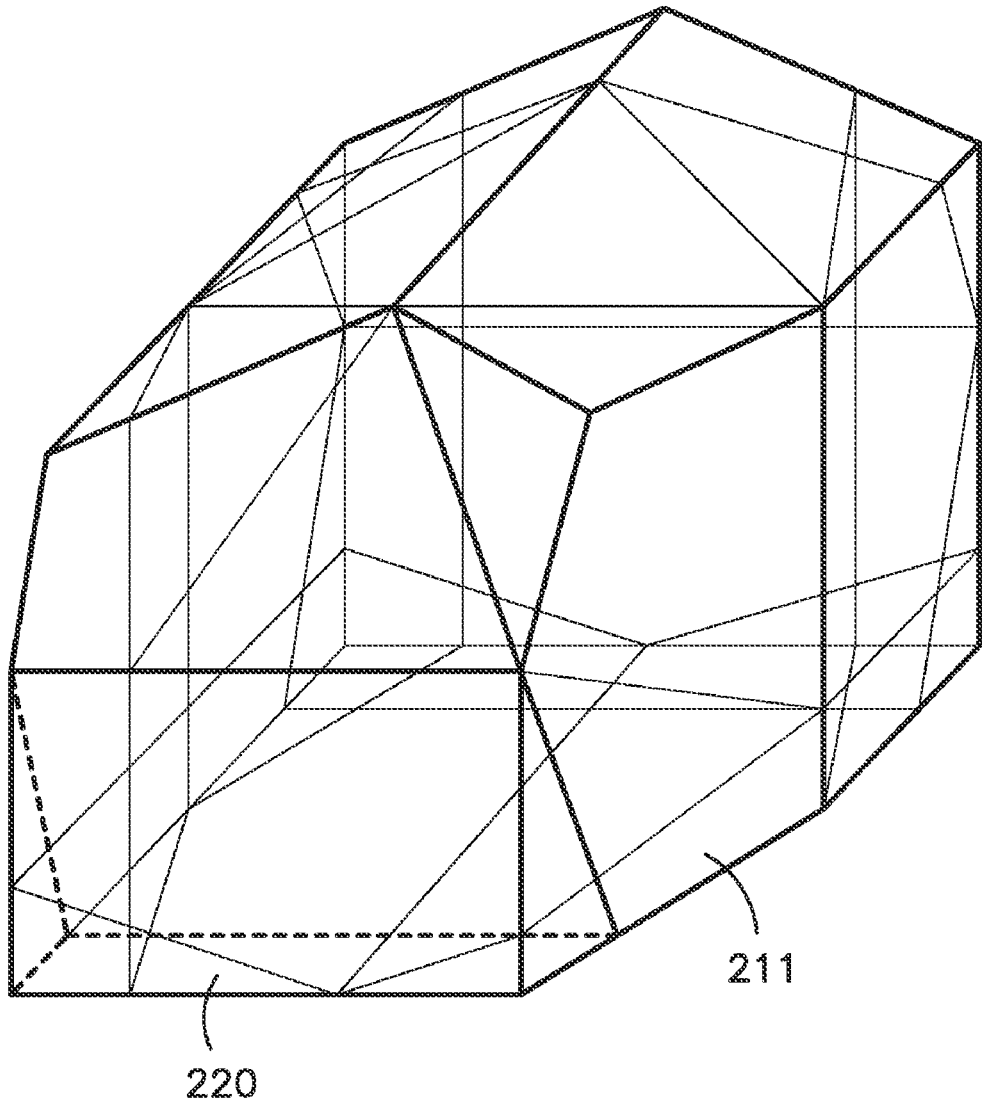
FIG. 22 is an external perspective view showing a fourth face of the regular icosahedron formed on the workpiece.
Figure 23:
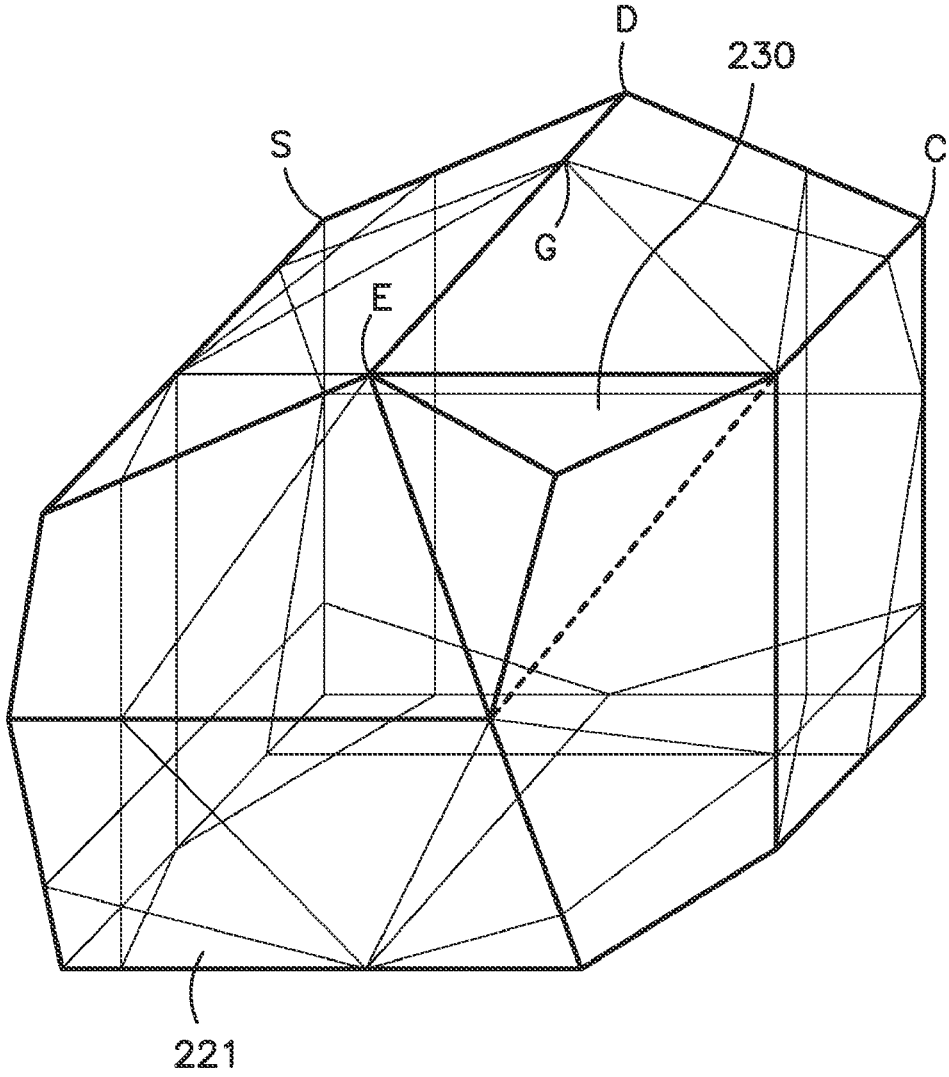
FIG. 23 is an external perspective view showing a fifth face of the regular icosahedron formed on the workpiece.
Figure 24:
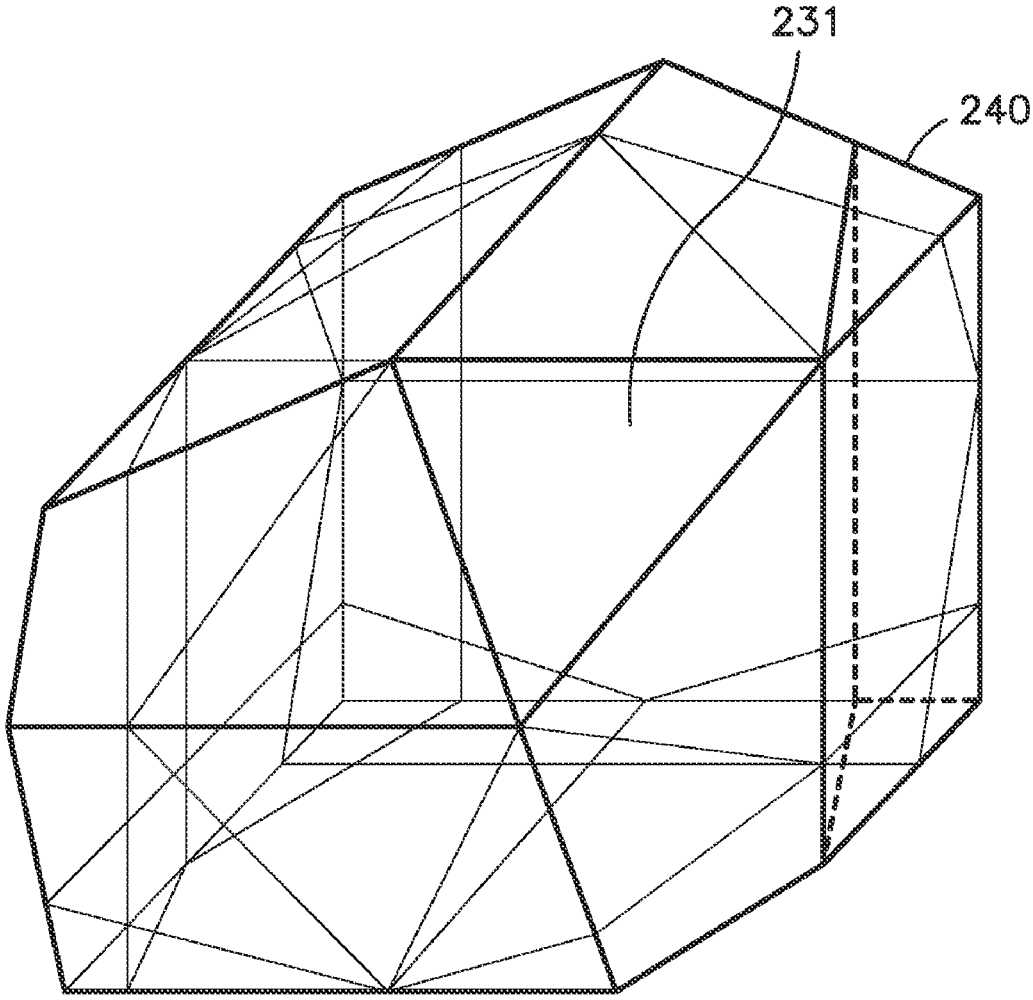
FIG. 24 is an external perspective view showing a sixth face of the regular icosahedron formed on the workpiece.
Figure 25:
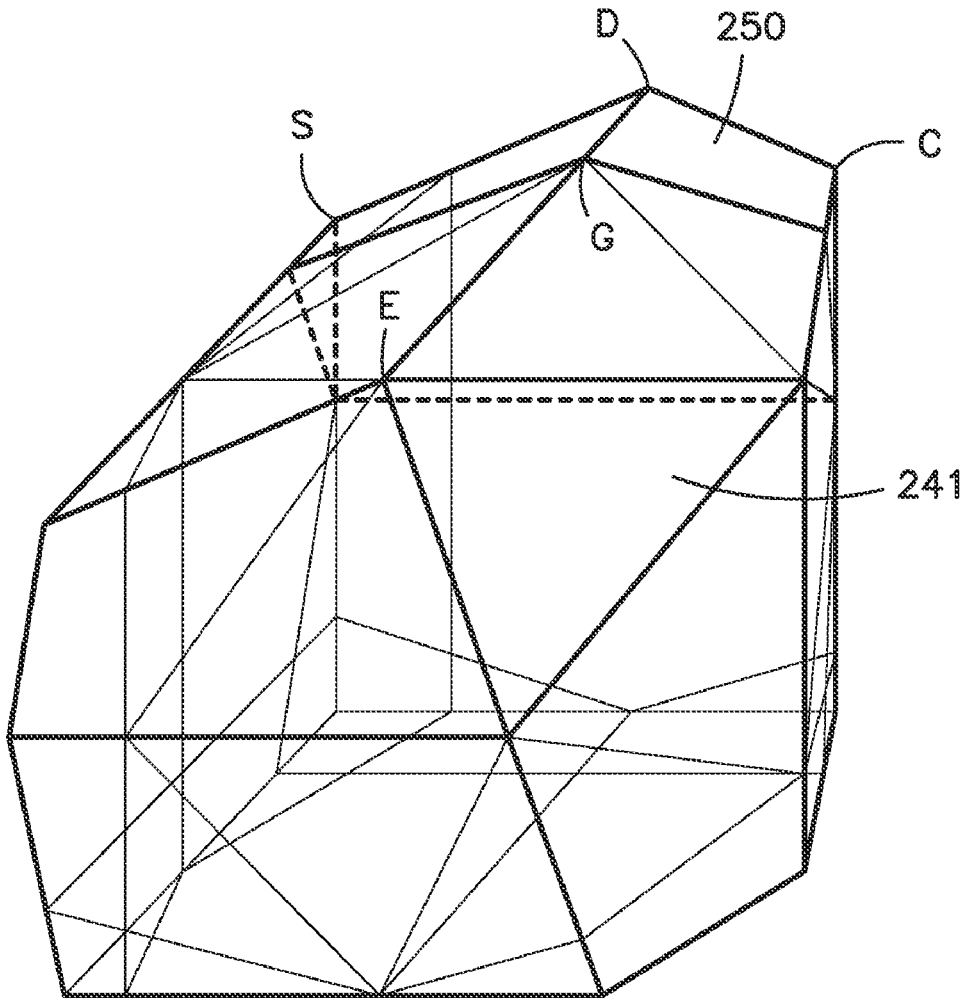
FIG. 25 is an external perspective view showing a seventh face of the regular icosahedron formed on the workpiece.
Figure 26:
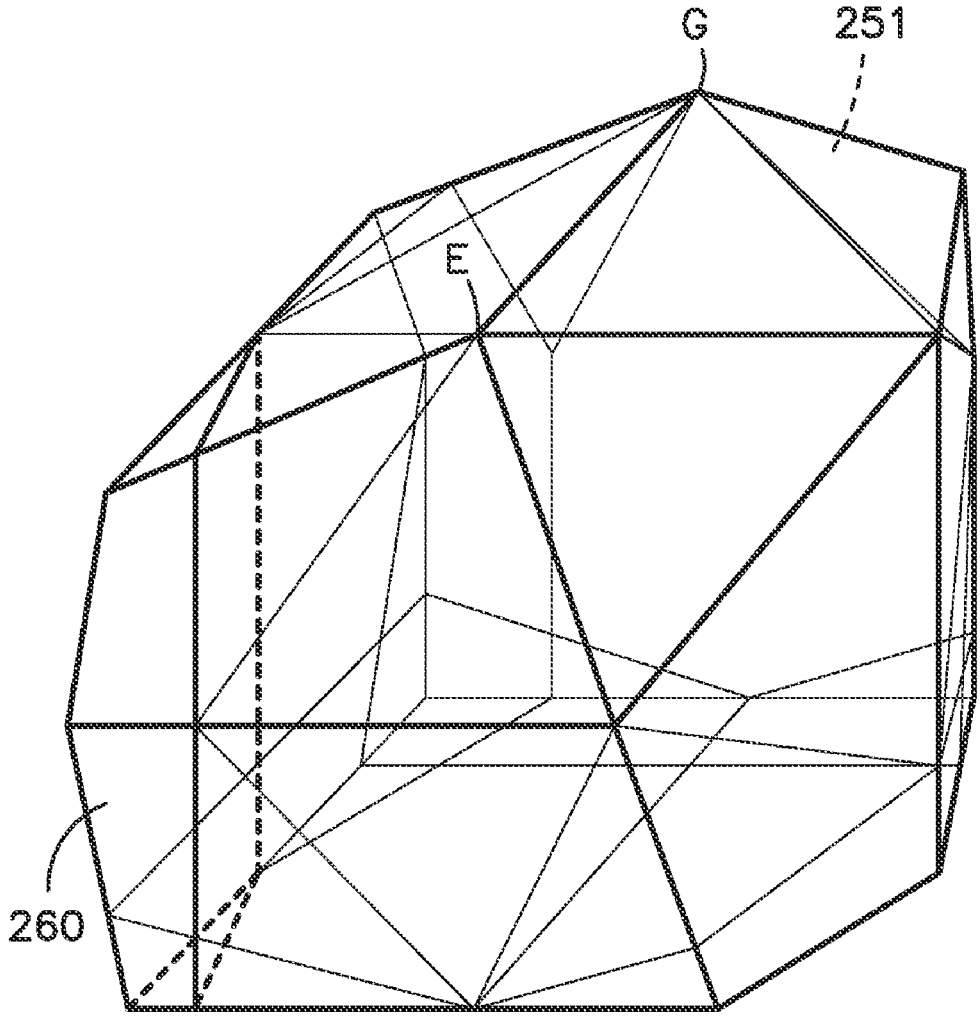
FIG. 26 is an external perspective view showing an eighth face of the regular icosahedron formed on the workpiece.
Figure 27:
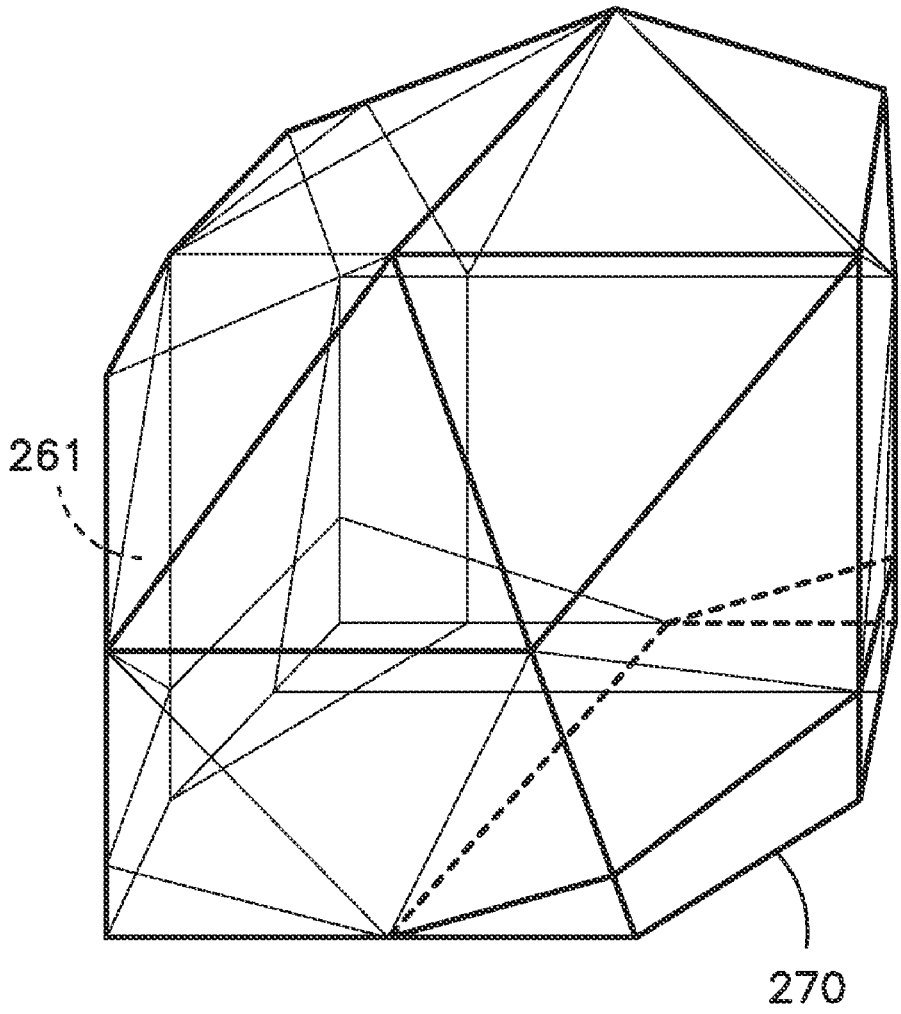
FIG. 27 is an external perspective view showing a ninth face of the regular icosahedron formed on the workpiece.
Figure 28:
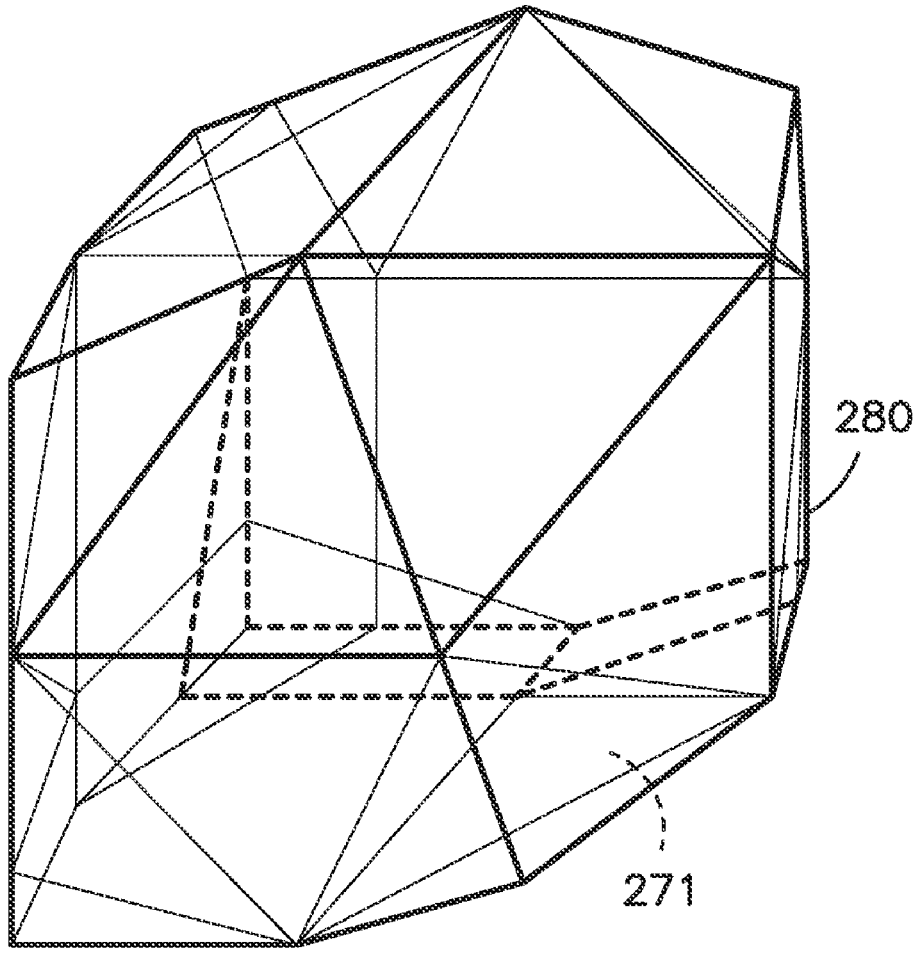
FIG. 28 is an external perspective view showing a 10th face of the regular icosahedron formed on the workpiece.
Figure 29:
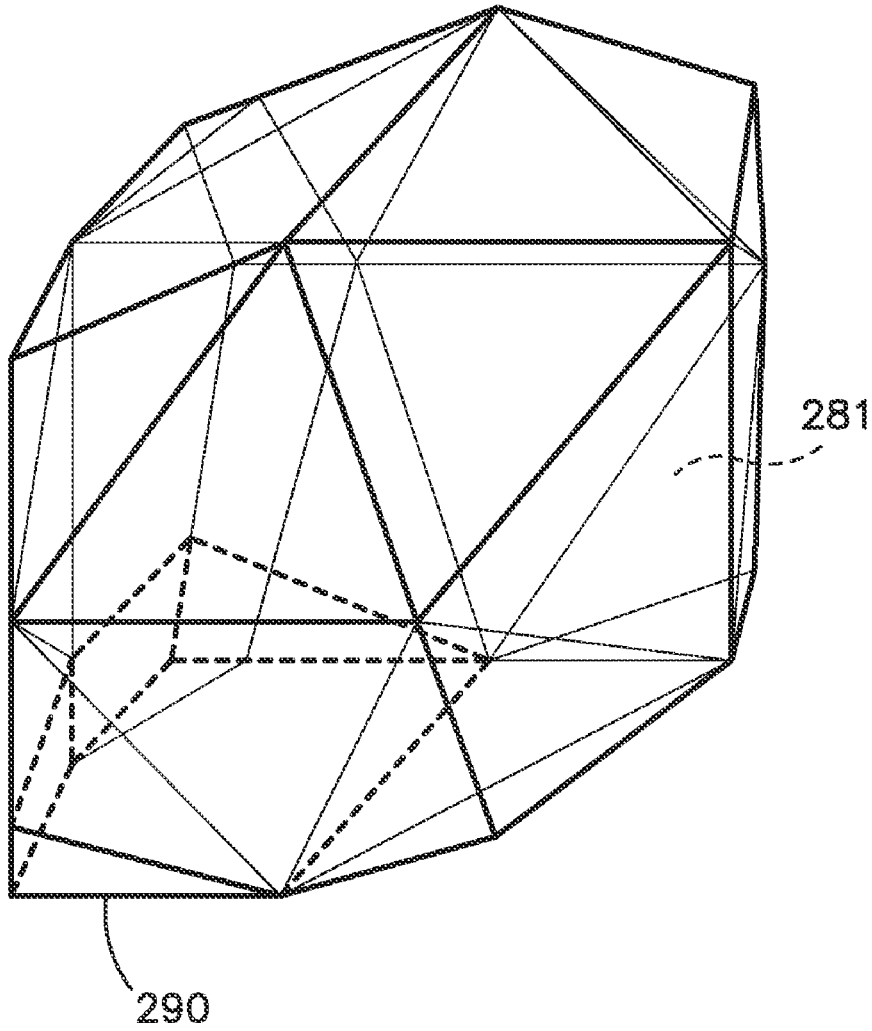
FIG. 29 is an external perspective view showing an 11th face of the regular icosahedron formed on the workpiece.
Figure 30:
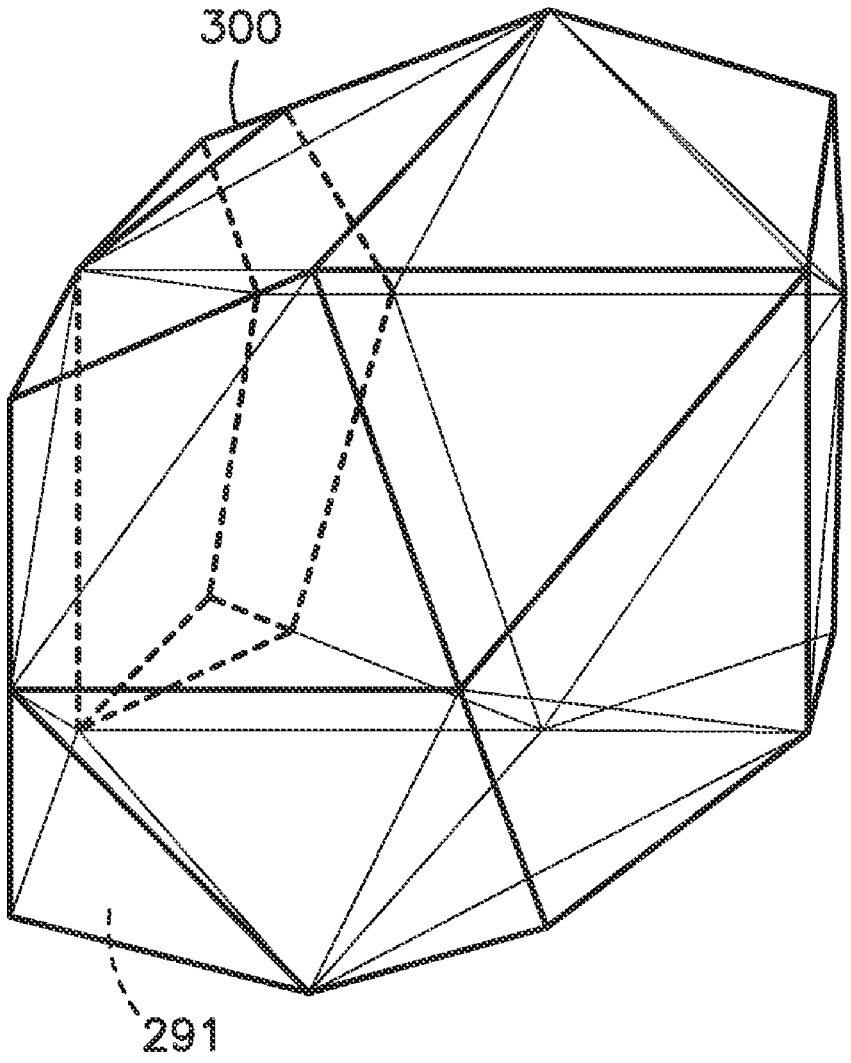
FIG. 30 is an external perspective view showing a 12th face of the regular icosahedron formed on the workpiece.
Figure 31:
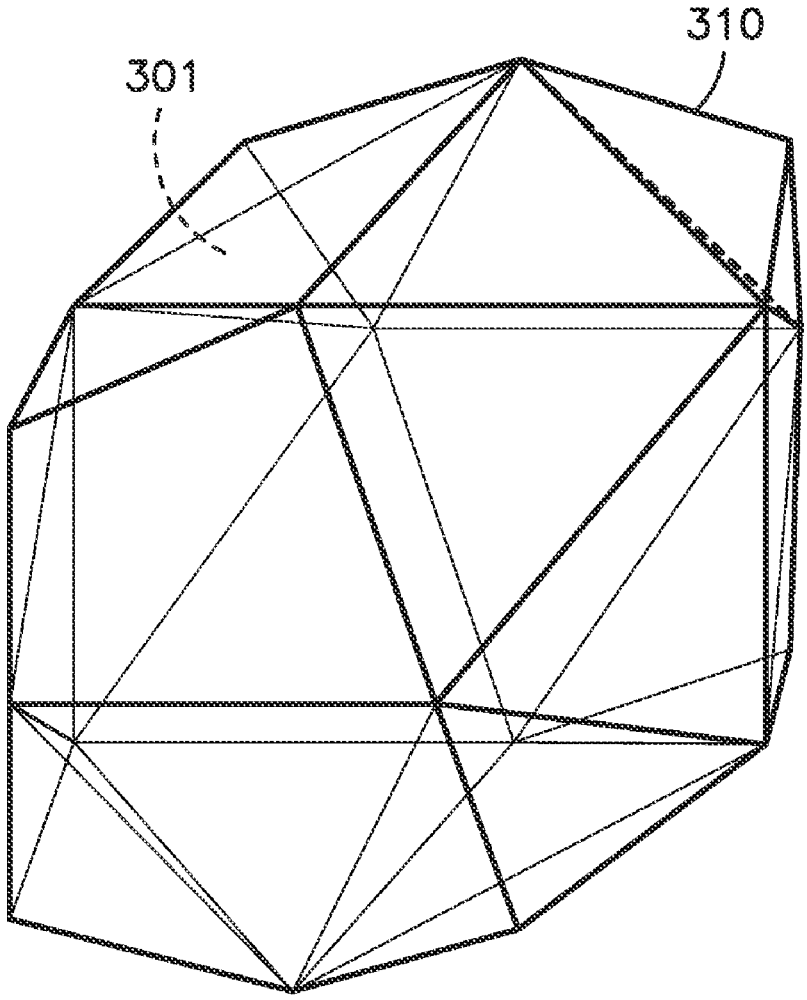
FIG. 31 is an external perspective view showing a 13th face of the regular icosahedron formed on the workpiece.
Figure 32:
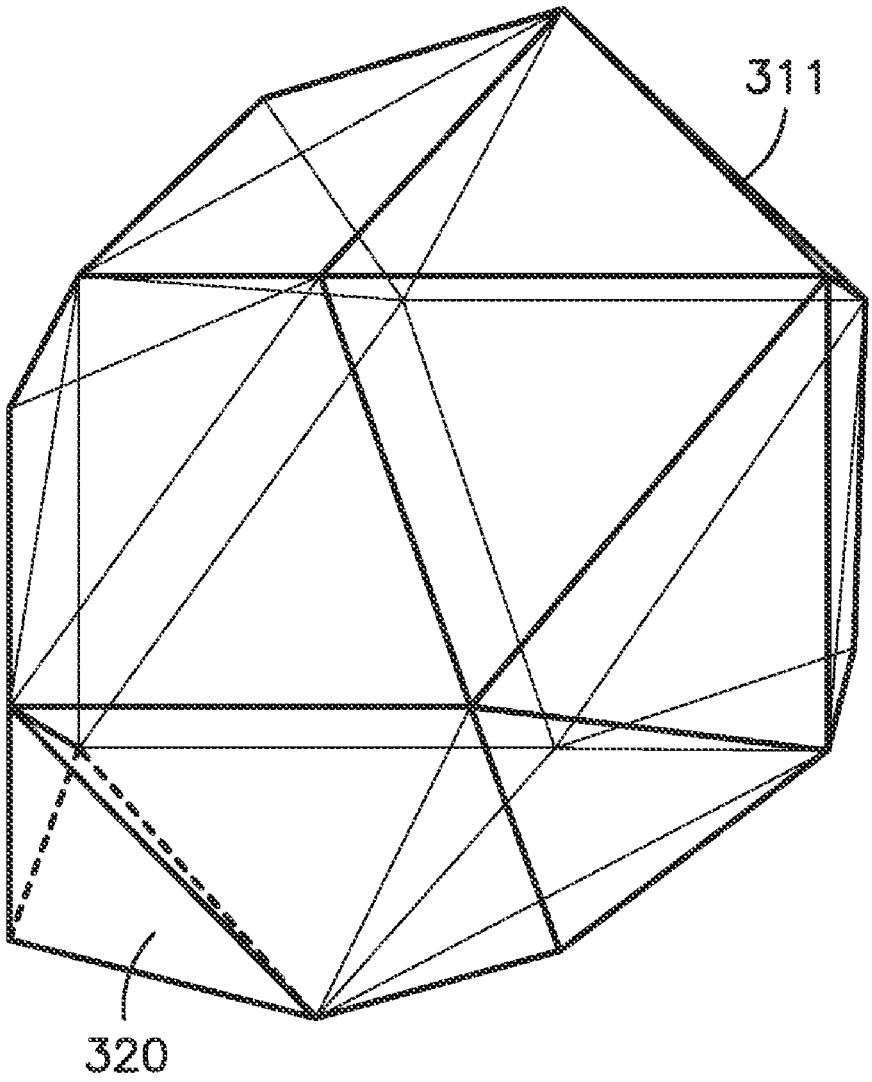
FIG. 32 is an external perspective view showing a 14th face of the regular icosahedron formed on the workpiece.
Figure 33:
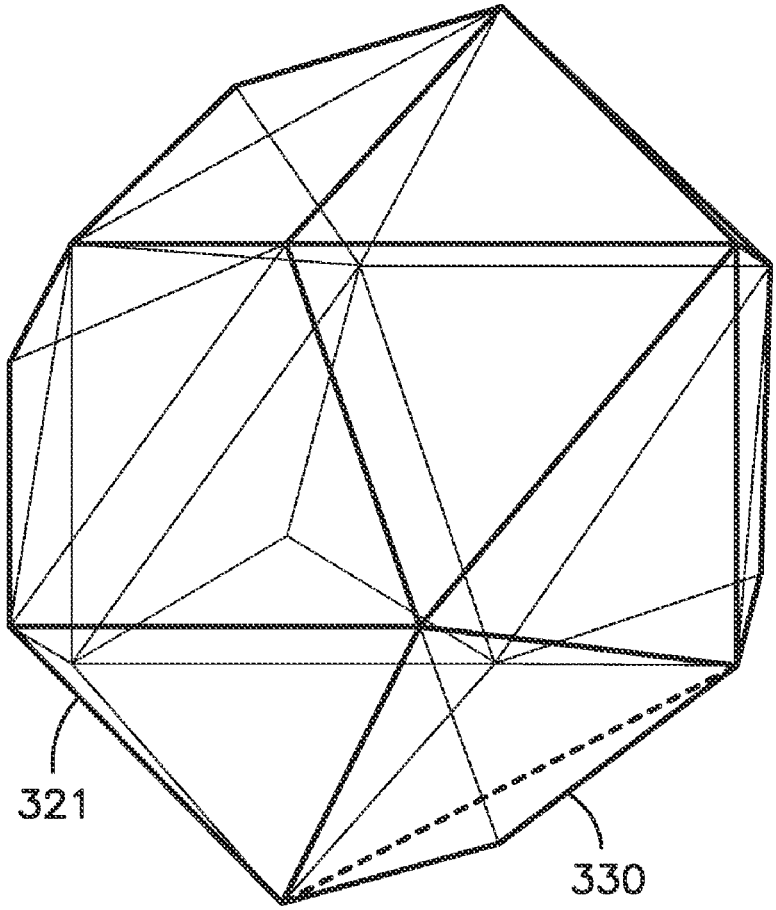
FIG. 33 is an external perspective view showing a 15th face of the regular icosahedron formed on the workpiece.
Figure 34:
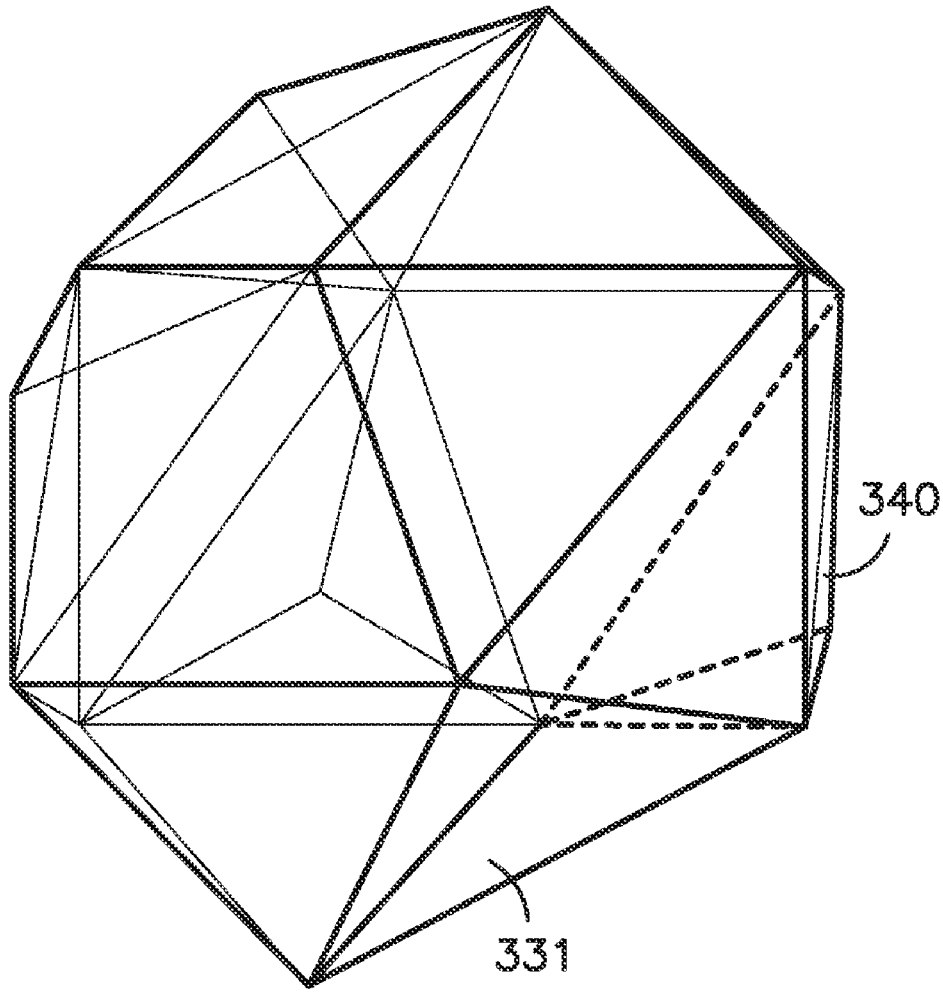
FIG. 34 is an external perspective view showing a 16th face of the regular icosahedron formed on the workpiece.
Figure 35:
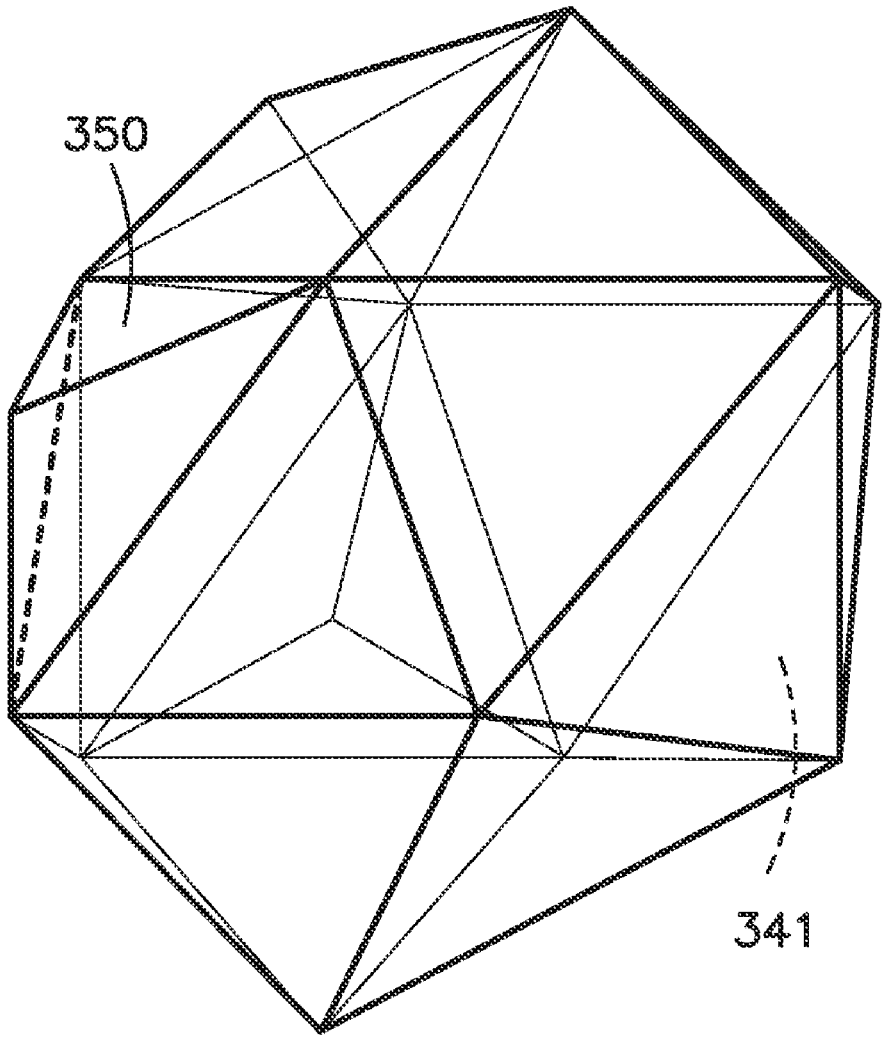
FIG. 35 is an external perspective view showing a 17th face of the regular icosahedron formed on the workpiece.
Figure 36:
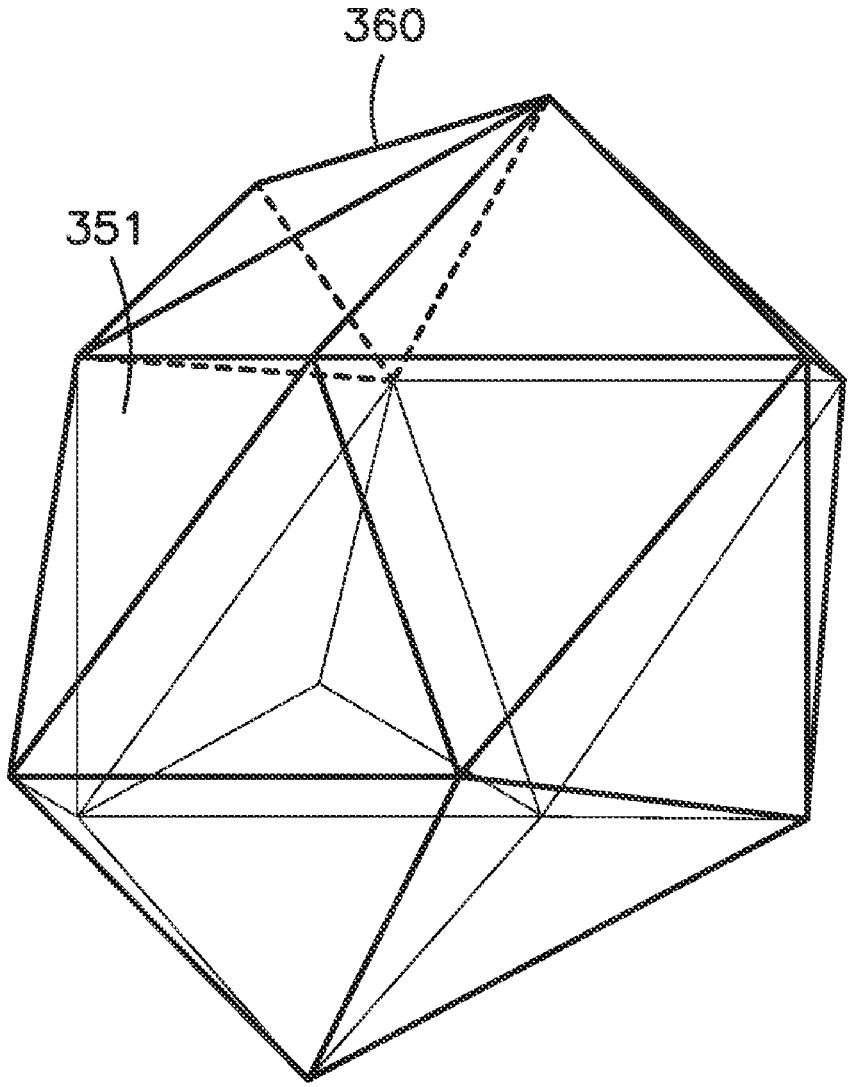
FIG. 36 is an external perspective view showing an 18th face of the regular icosahedron formed on the workpiece.
Figure 37:
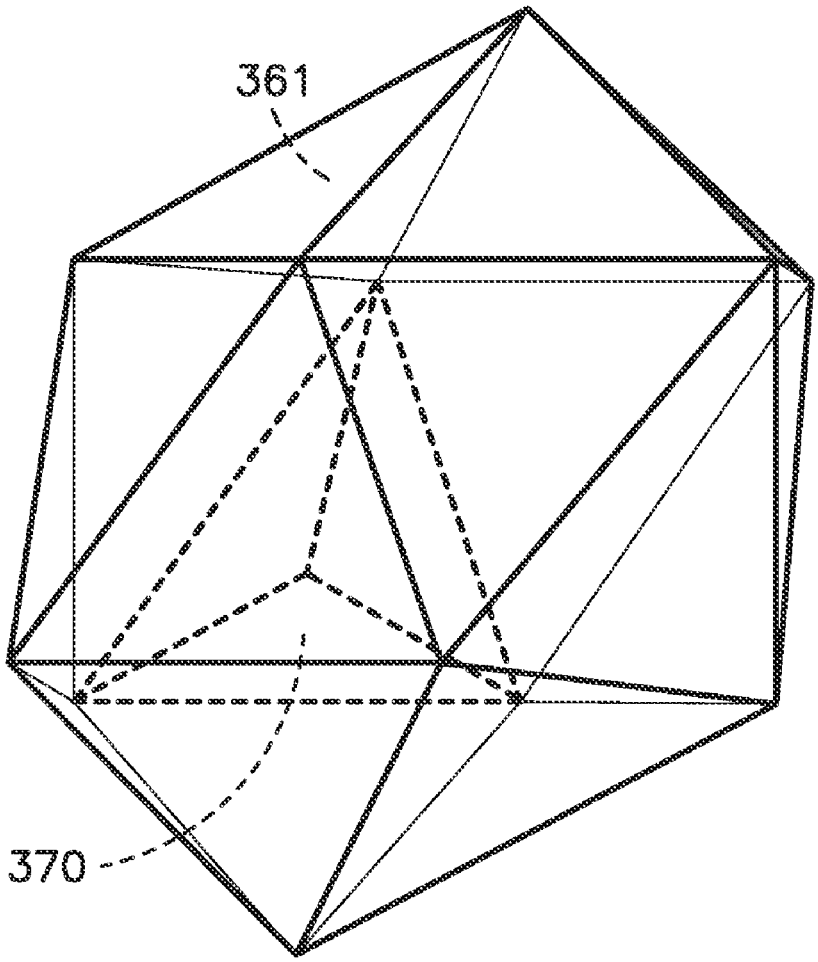
FIG. 37 is an external perspective view showing a 19th face of the regular icosahedron formed on the workpiece.
Figure 38:
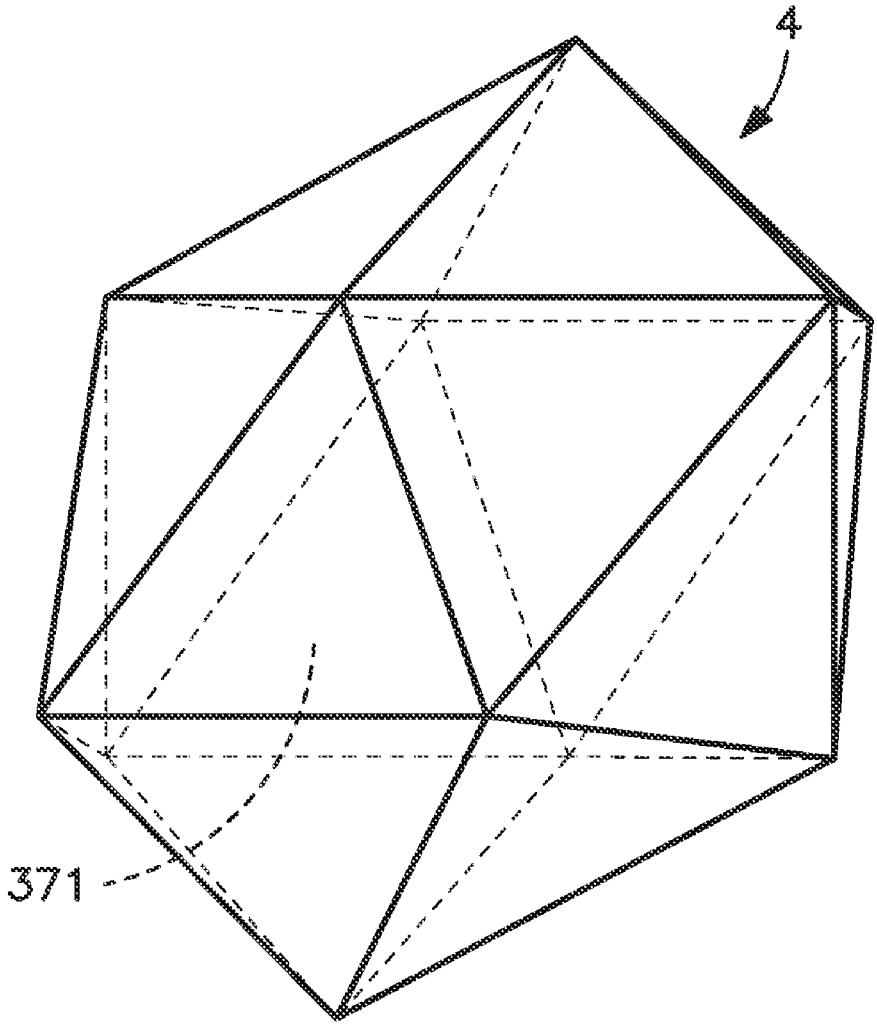
FIG. 38 is an external perspective view showing the 20th face of the regular icosahedron formed on the workpiece.
Figure 39:
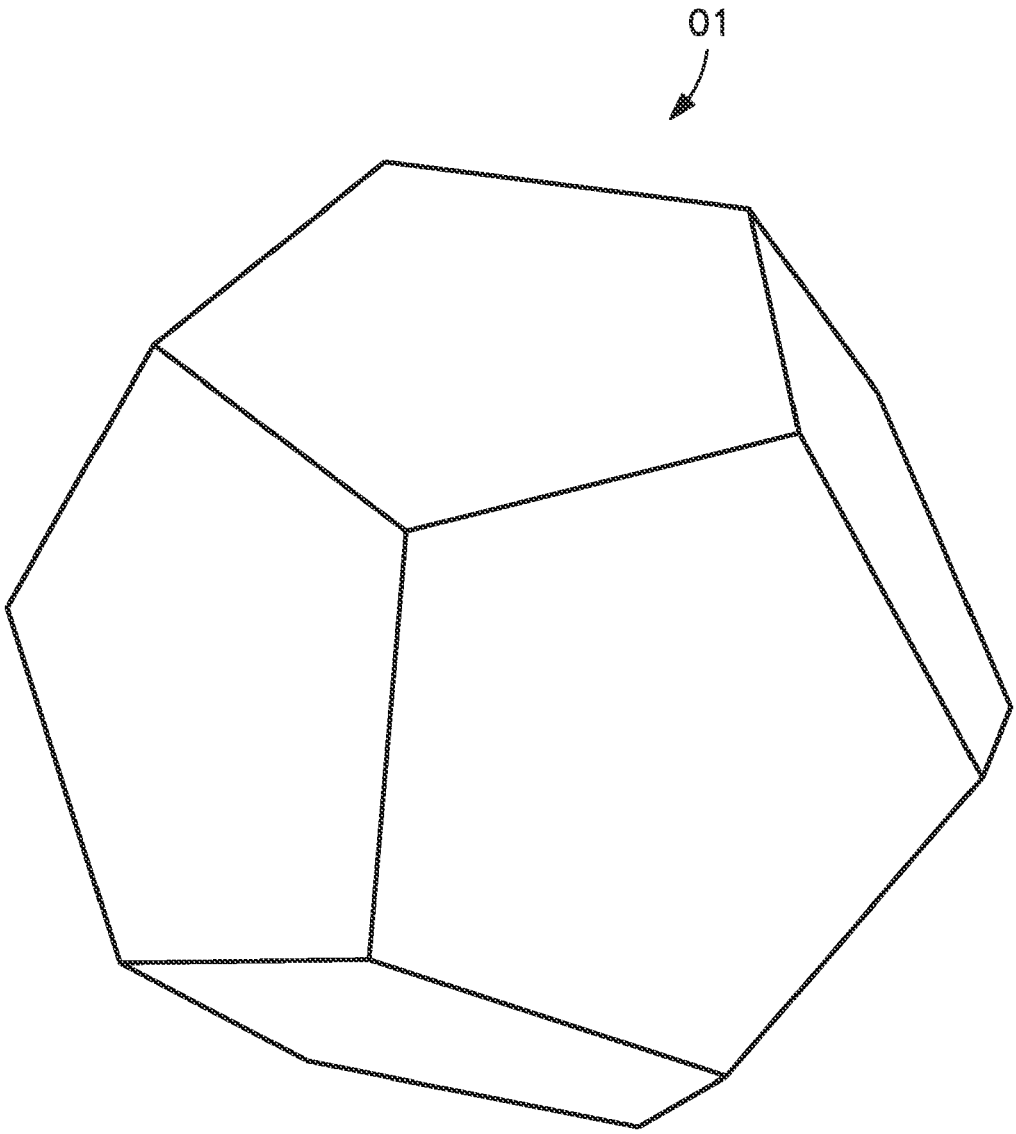
FIG. 39 is an external perspective view showing the external shape of the regular dodecahedron.
Figure 40:
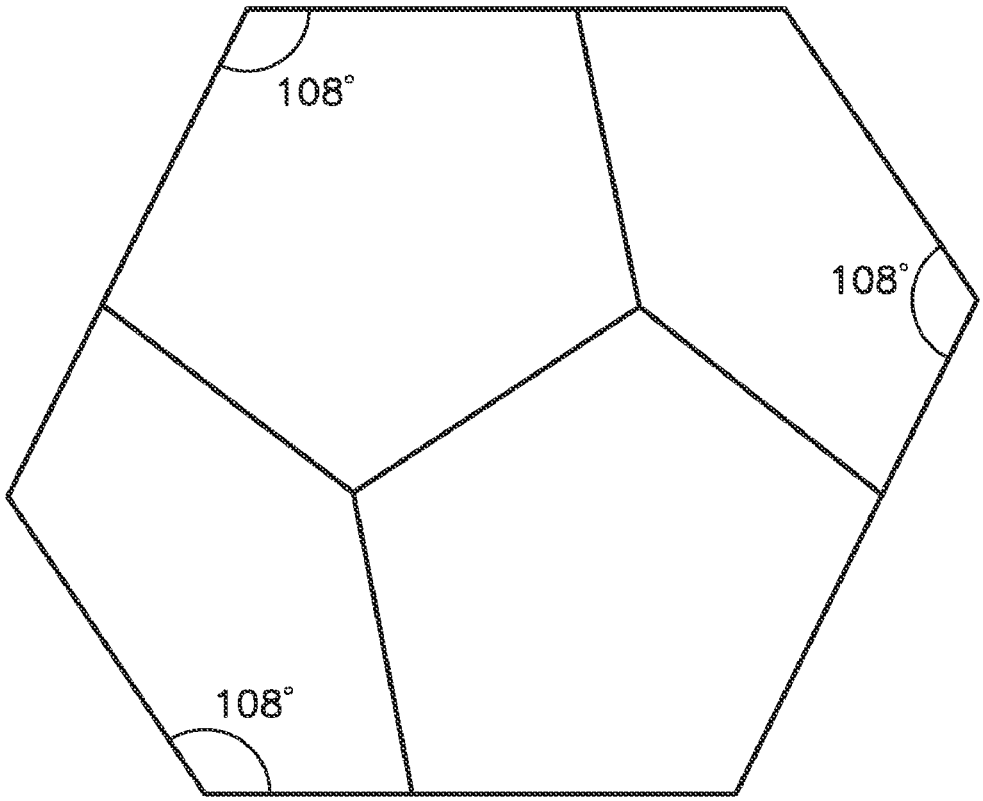
FIG. 40 is an external side view showing the regular dodecahedron shown in FIG. 39.

As shown in FIG. 20, a cutout portion 200 is cut away by cutting the possible cut face that is envisaged from the cutting base lines and the auxiliary cutting lines to form a third face 201 shown in FIG. 21, then followed by drawing auxiliary cutting lines on the third face. Such a step is repeated until the 20th face of the regular icosahedron is formed. That is, in FIG. 21, a cutout portion 210 is determined to be cut away from the possible cut face, thereby allowing a fourth face 211 to be formed as shown in FIG. 22. A cutout portion 220 in the shape of a triangular prism shown in FIG. 22 is cut away, thereby forming a fifth face 221 shown in FIG. 23. A cutout portion 230 in the shape of a triangular prism shown in FIG. 23 is cut away, thereby forming a sixth face 231 (FIG. 24). A cutout portion 240 of FIG. 24 is cut away, thereby forming a seventh face 241 (FIG. 25). A cutout portion 250 in FIG. 25 is cut away, thereby forming an eighth face 251 (FIG. 26). A cutout portion 260 in FIG. 26 is cut away, thereby forming a ninth face 261 (FIG. 27). A cutout portion 270 in FIG. 27 is cut away, thereby forming a 10th face 271 (FIG. 28). A cutout portion 280 in FIG. 28 is cut away, thereby forming an 11th face 281 (FIG. 29). A cutout portion 290 in FIG. 29 is cut away, thereby forming a 12th face 291 (FIG. 30). A cutout portion 300 in FIG. 30 is cut away, thereby forming a 13th face 301 (FIG. 31). A cutout portion 310 having the shape of a triangular cone in FIG. 31 is cut away, thereby forming a 14th face 311 in the shape of a regular triangle (FIG. 32). A cutout portion 320 having the shape of a triangular cone in FIG. 32 is cut away, thereby forming a 15th face 321 in the shape of a regular triangle (FIG. 33). A cutout portion 330 having the shape of a triangular cone in FIG. 33 is cut away, thereby forming a 16th face 331 in the shape of a regular triangle (FIG. 34). A cutout portion 340 having the shape of a triangular cone in FIG. 34 is cut away, thereby forming a 17th face 341 in the shape of a regular triangle (FIG. 35). A cutout portion 350 having the shape of a triangular cone in FIG. 35 is cut away, thereby forming an 18th face 351 in the shape of a regular triangle (FIG. 36). A cutout portion 360 having the shape of a triangular cone in FIG. 36 is cut away, thereby forming a 19th face in the shape of a regular triangle (FIG. 37). A cutout portion 370 having the shape of a triangular cone in FIG. 37 is cut away, thereby forming the 20th face 371 in the shape of a regular triangle as shown in FIG. 38.

In this manner, the regular icosahedral ornament 4 according to the second embodiment is completely manufactured, and then the faces thereof may be polished using appropriate polishing means to thereby completely manufacture an ornament such as a memorial stone, a tomb stone, a decorative item, or an object.

In both the aforementioned first and second embodiments, the regular dodecahedral ornament 2 and the regular icosahedral ornament 4 are manufactured in this manner. To this end, the surfaces of the cubic workpieces 1 and 3 prepared at the beginning are drawn by marking or the like with cutting base lines indicative of the geometric features of each regular polyhedron, and then each cubic workpiece is cut based thereon. Even when the cutting causes the aforementioned cutting base lines to be erased, auxiliary cutting lines are drawn on a newly exposed surface to supplement the erased cutting base lines and thus define a possible cut face, which is in turn cut. This procedure is repeated, thereby making it possible to easily manufacture the cubic workpieces 1 and 3 of single stone into the ornaments 2 and 4.

Although the embodiments of the present invention have been described in detail with reference to the drawings, it is to be understood that specific structures are not limited to these embodiments, and any modifications to design made without departing from the sprit of the present invention would be also included in the scope of the present invention.

That is, the descriptions have been made to the stone used in the aforementioned first and second embodiments which is a natural stone. However, the present invention is also applicable to the manufacturing of an ornament of a raw material such as wood or glass.

Furthermore, in the foregoing, the descriptions were made to the case where a grinding wheel used as a cutting tool was rotated for cutting. However, instead of it, a laser beam can also be used for cutting.

ADVANTAGES OF THE INVENTION

As described above, according to the invention set forth in claim 1, a stone is shaped into a cube in preparation for a raw workpiece. The six external surfaces of the cube are marked with cutting base lines which define faces determined by the geometric features of the regular polyhedron and ridges forming the contours of the faces. Then, first and second faces of the regular polyhedron are cut based on the cutting base lines and thereafter new auxiliary cutting lines are drawn on these faces. Further, a new third regular polyhedral face is cut based on the auxiliary cutting lines and the cutting base lines. Subsequently thereafter, the auxiliary cutting lines are marked by drawing in sequence every time a new face of the regular polyhedron is cut in the same procedure from fourth to 12th or to 20th faces, thereby allowing the cubic workpiece to be cut into the regular polyhedron while the cutting base lines which are erased after each cutting are being complemented by the auxiliary cutting lines. This makes it possible to easily manufacture a regular polyhedral ornament using a cutting tool.

Furthermore, according to the invention set forth in claim 2, a stone is shaped into a cube in preparation for a raw workpiece to be manufactured into a regular polyhedron which is inscribed in the cube. To this end, the six external surfaces of the cube are marked by drawing with cutting base lines which define faces obtained from the geometric features of the regular polyhedron and ridges forming the contours of the faces. Then, first and second faces adjacent to each other are cut based on the cutting base lines. Then, auxiliary cutting lines are drawn on these faces having been cut to form a new third face based on the auxiliary cutting lines and the cutting base lines. Every time a new face is created by cutting in sequence, the auxiliary cutting lines are drawn to form a new possible cut face. In this manner, the cutting base lines indicative of the geometric features of the regular polyhedron being erased after each cutting will be complemented by new auxiliary cutting lines being marked by drawing. This makes it possible to easily cut a possible cut face defined by cutting base lines and auxiliary cutting lines without using a conventional, costly computer-controlled shaping machine. It is thus possible to easily cut the cubic workpiece into a regular polyhedral ornament.

Furthermore, according to the invention set forth in claim 3, the cutting base lines, indicative of the geometric features of a regular polyhedron, which are marked on each surface of the cubic workpiece include a median line, two parallel lines which are orthogonal to the median line, and four diagonal lines which are diagonal to the parallel lines at the four corners of each surface. Since these lines are straight, each surface can be marked easily. This makes it possible to easily cut the regular dodecahedron into an ornament using a cutting tool in accordance with the straight lines that are marked based on the geometric features thereof.

Furthermore, according to the invention set forth in claim 4, the cutting base lines, indicative of the geometric features of a regular polyhedron, which are marked on each surface of the cubic workpiece include a median line, two parallel lines which are orthogonal to the median line, and four diagonal lines which are diagonal to the parallel lines at the four corners of each surface. Since these lines are straight, each surface can be marked easily. This makes it possible to easily cut the regular icosahedron into an ornament using a cutting tool.

Furthermore, according to the invention set forth in claim 5, the method for manufacturing a regular polyhedron can be used to easily shape a single cubic workpiece, for example, such as of natural stone, wood, or glass into an ornament which may be used as a memorial stone, an object, a tomb stone, a monument or the like. This can be done through simple cutting work using only a cutting tool without a need for a costly, extensive machine or apparatus.

The invention claimed is:

1. A method for manufacturing a regular polyhedral ornament such as a regular dodecahedron or a regular icosahedron, the method comprising:

(a) shaping a stone into a cube, so as to provide a raw cubic workpiece; and (b) a cutting process comprising cutting the cubic workpiece so as to form a regular polyhedron therefrom, the cutting process comprising:

(i) marking six eternal surfaces of the cubic workpiece with cutting base lines which define faces determined by geometric features of the regular polyhedron and ridges forming contours of the faces;

(ii) cutting the cubic workpiece along the cutting base lines to form first and second faces, having ridges in common, of the regular polyhedron;

(iii) drawing auxiliary cutting lines on the first and second faces so as to compensate for portions of cutting base lines erased during the above cutting step;

(iv) cutting a third face of the regular polyhedral by cutting along the auxiliary cutting lines and the cutting base lines; and (v) repeating steps (iii) and (iv) above, so as to form remaining faces of the regular polyhedron, including subsequently drawing auxiliary cutting lines in sequence every time a new face of the regular polyhedron is cut, thereby forming the regular polyhedron.

2. A method for manufacturing a regular polyhedral ornament, the method comprising:

(a) shaping a stone into a cube, so as to provide a raw cubic workpiece; and (b) a cutting process comprising cutting the cubic workpiece into a regular polyhedron, the cutting process comprising:

(i) marking six eternal surfaces of the cubic workpiece with cutting base lines which define faces obtained from the geometric features of the regular polyhedron and ridges forming the contours of the faces;

(ii) cutting the cubic workpiece adjacent the cutting base lines so as to form first and second faces, said first and second faces being adjacent to each other and having one or more common ridges;

(iii) drawing auxiliary cutting lines on the faces of the cubic workpiece so as compensate for portions of the cutting base lines erased during formation of the first and second faces and to define ridges of the regular polyhedron determined by intersections of the cutting base lines and the faces;

(iv) cutting a third face of the regular polyhedron based on the auxiliary cutting lines and the cutting base lines; and (v) repeating steps (iii) and (iv) above every time a new face is created, thereby allowing the cubic workpiece to be cut into the regular polyhedral ornament.

3. The method for manufacturing a regular polyhedral ornament according to claim 2, wherein the regular polyhedron is a regular dodecahedron, having an edge of a length of two, said method further comprising:

(vi) plotting a midpoint and two division points located about the midpoint at a distance of$(1+\sqrt{5})/2$ from each vertex on each of the four perimeter edges or ridges on each surface of the cubic workpiece; and (vii) marking additional cutting base lines on each surface of the cubic workpiece, based on the geometric features of the regular dodecahedron, the additional cutting base lines comprising: a median line which connects between the midpoints on an edge and the opposite edge; two parallel lines which are orthogonal to the median line and which connect respectively between two division points located on respective edges adjacent to the edge and the opposite edge; and four diagonal lines which are diagonal to the parallel lines and which respectively connect between each of the division points on the edge and the opposite edge and each of the midpoints on the respective adjacent edges.

4. The method for manufacturing a regular polyhedral ornament according to claim 2, wherein the regular polyhedron is a regular icosahedron having an edge of a length of$(1+\sqrt{5})$, said method further comprising:

(v) plotting a midpoint and two division points located about the midpoint at a distance of one from each vertex on each of the four perimeter edges or ridges on each surface of the cubic workpiece; and (vi) marking additional cutting base lines on each surface of the cubic workpiece, based on the geometric features of the regular icosahedron, the additional cutting base lines comprising: a median line which connects between midpoints on an edge and the opposite edge; two parallel lines which are orthogonal to the median line and which connect respectively between two division points located on the respective edges adjacent to the edge and the opposite edge; and four diagonal lines which are diagonal to the parallel lines and which respectively connect between each of the division points on the edge and the opposite edge and each of the midpoints on the respective adjacent edges.

* * * * *